US009254069B2

(12) United States Patent
Kim et al.

(10) Patent No.: US 9,254,069 B2
(45) Date of Patent: Feb. 9, 2016

(54) VACUUM CLEANER

(71) Applicant: SAMSUNG ELECTRONICS CO., LTD., Suwon-si, Gyeonggi-do (KR)

(72) Inventors: Tae Gwang Kim, Gwangju (KR); Tak Soo Kim, Gwangju (KR); Oh Kyu Kwon, Suwon-si (KR); Dong Hun Yoo, Gwangju (KR); Joo Seok Jeong, Suwon-si (KR); Tae Woon Lim, Suwon-si (KR); Byung Jo Lee, Gwangju (KR); Yun Won Jung, Gwangju (KR); Jeong Hee Cho, Gwangju (KR); Jung Hoon Hong, Busan (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/476,125

(22) Filed: Sep. 3, 2014

(65) Prior Publication Data

US 2015/0059122 A1 Mar. 5, 2015

(30) Foreign Application Priority Data

Sep. 5, 2013 (KR) ..... 10-2013-0106744
May 2, 2014 (KR) ..... 10-2014-0053518
May 12, 2014 (KR) ..... 10-2014-0056772

(51) Int. Cl.
*A47L 5/28* (2006.01)
*A47L 9/00* (2006.01)

(52) U.S. Cl.
CPC .. *A47L 5/28* (2013.01); *A47L 9/009* (2013.01)

(58) Field of Classification Search
CPC ..... A47L 5/28; A47L 9/009; A47L 9/02; A47L 9/325; A47L 9/327
See application file for complete search history.

(56) References Cited

U.S. PATENT DOCUMENTS 7,607,196 B2 * 10/2009 Li ..... A47L 5/28 15/350
7,805,804 B2 * 10/2010 Loebig ..... A47L 5/28 15/351
7,950,102 B2 * 5/2011 Lee ..... A47L 9/325 15/327.4
8,667,643 B2 * 3/2014 Simonelli ..... A47L 9/009 15/143.1
9,009,915 B2 * 4/2015 Song ..... A47L 5/28 15/354
9,027,200 B2 * 5/2015 Chong ..... A47L 5/28 15/351
2012/0233806 A1 * 9/2012 Streciwilk ..... A47L 5/28 15/347

* cited by examiner

*Primary Examiner* — Dung Van Nguyen
(74) *Attorney, Agent, or Firm* — Staas & Halsey LLP

(57) ABSTRACT

A vacuum cleaner that includes an upright main body, an upright fan motor generating a suction force, and a wheel assembly that is mounted on the upright main body and guides movement and rotation of the upright main body. The upright main body includes a first housing that is installed on the wheel assembly so as to be rotatable in a leftward/rightward direction, and a second housing that is installed in the first housing so as to be rotatable in a forward/backward direction. The vacuum cleaner can be moved and rotated by freely moving an extension frame extending upward from the second housing in forward, backward, leftward, and rightward directions.

15 Claims, 27 Drawing Sheets

VACUUM CLEANER

CROSS-REFERENCE TO RELATED APPLICATIONS

This application claims the benefit of Korean Patent Application Nos. 10-2013-0106744, 10-2014-0053518 and 10-2014-0056772, filed on Sep. 5, 2013, May 2, 2014 and May 12, 2014, respectively, in the Korean Intellectual Property Office, the disclosures of which are incorporated herein by reference.

BACKGROUND

1. Field

Embodiments of the present disclosure relate to a vacuum cleaner capable of changing a direction in a smoother way.

2. Description of the Related Art

In general, vacuum cleaners are appliances designed to do cleaning by suctioning dust along with air using a suction force generated from a fan rotated by a motor, separating the dust included in the suctioned air from the air, and collecting the separated dust.

Such vacuum cleaners include a main body with a fan motor generating a suction force, a head unit that is disposed in the front of the main body and suctions dust from a floor along with air, a handle grasped by a user so as to allow movement of the vacuum cleaner, and an extension frame that connects the handle and the main body and enables the user to move the main body while in an upright posture. However, the structure of the conventional vacuum cleaners is such that while a forward and backward movement of the vacuum cleaner may be accomplished by a user, other movements such as left or right, are more difficult and cause inconvenience to a user.

Further, some of the vacuum cleaners have recently been designed to include an upright dust collection unit that causes dust to be filtered by a principle of centrifugal separation during a cyclonic flow of air.

SUMMARY

Therefore, it is an aspect of the present disclosure to provide a vacuum cleaner capable of changing a direction in a smoother way.

Further, it is another aspect of the present disclosure to provide a vacuum cleaner capable of being rotated left and right with a smaller radius of rotation.

In addition, it is yet another aspect of the present disclosure to provide a vacuum cleaner having a structure capable of transmitting a suction force to one of a head unit and a pipe module depending on whether or not the pipe module is decoupled.

Additional aspects of the disclosure will be set forth in part in the description which follows and, in part, will be apparent from the description, or may be learned by practice of the disclosure.

In accordance with an aspect of the present disclosure, a vacuum cleaner includes an upright main body; an upright fan motor generating a suction force; and a wheel assembly that is mounted on the upright main body and guides movement and rotation of the upright main body, wherein the upright main body includes a first housing that is installed on the wheel assembly so as to be rotatable in a leftward/rightward direction, and a second housing that is installed in the first housing so as to be rotatable in a forward/backward direction and houses the upright fan motor.

Here, the vacuum cleaner may further include a head unit that is connected at a front side of the upright main body and suctions foreign materials from a floor to be cleaned. The head unit may include a connecting tube that is formed in a hollow cylindrical shape, extends backward, and is connected to the upright main body, and the first housing may have a center of rotation located on an extension line of a central axis of the connecting tube.

Further, the head unit may be rotated left or right relative to the wheel assembly by leftward or rightward rotation of the upright main body.

Further, one of the upright main body and the wheel assembly may include a pair of guide rails that extend to be inclined toward a rear lower side, and the other of the upright main body and the wheel assembly may include a pair of guides that are installed to move along the guide rails.

Further, the upright main body may be formed to have a spherical surface at both sides of the front thereof, and the wheel assembly may include a pair of rotatable wheels and a wheel bracket on which the pair of wheels are rotatably installed. The guide rails may be formed at both sides of the front of the upright main body formed in the spherical surface, and the guides may be formed inside the wheel bracket.

Also, the spherical surface may have a center identical to the center of rotation of the first housing.

Further, the wheel assembly may include multiple rollers that are disposed inside the wheel bracket and rotatably support the first housing.

Further, the pair of wheels may have positive (+) camber.

Further, the vacuum cleaner may further include an upright dust collection unit that is mounted at an upper portion of the second housing and collects dust from air suctioned through the head unit.

Further, the upright main body may include a locking jaw protruding from one of an inner surface of the first housing and an outer surface of the second housing, and a locking member that is provided for the other of the inner surface of the first housing and the outer surface of the second housing, moves along with rotation of the second housing, and is locked by the locking jaw.

Also, the locking member may include a roller.

Further, the upright main body may further include a locking bracket on which the locking member is rotatably installed, and at least one spring, one end of which is supported on the second housing, and the other end of which is supported on the locking bracket; and the locking jaw may be provided for the inner surface of the first housing.

Further, the vacuum cleaner may further include an extension frame that extends upward from the upright main body, and the locking member may be locked by the locking jaw in a state in which the extension frame is vertically disposed.

Also, the vacuum cleaner may further include an extension frame that extends upward from the second housing, and a handy cleaner module that is removably installed on the extension frame.

Further, the handy cleaner module may include a handy main body, and the handy main body may include a handle provided to be graspable by a user.

In accordance with another aspect of the present disclosure, a vacuum cleaner includes an upright main body; a head unit that is mounted on the upright main body and suctions foreign materials from a floor to be cleaned; and a wheel assembly that is mounted on the upright main body and guides movement and rotation of the upright main body, wherein the upright main body is installed on the wheel assembly so as to be rotatable left and right, and the head unit is horizontally installed on the wheel assembly so as to be rotatable left and right and is rotated left or right relative to the wheel assembly in correspondence with leftward or rightward rotation of the wheel assembly.

In accordance with yet another aspect of the present disclosure, a vacuum cleaner includes: an upright main body housing a fan motor; a head unit receiving a suction force generated from the fan motor to clean a floor; an extension frame extending upward from the upright main body; a pipe module removably coupled to the extension frame; a connecting hose connecting the pipe module and the upright main body; and a channel converter causing the suction force generated from the fan motor to be transmitted to the pipe module by decoupling the pipe module. The channel converter includes: a converting duct that forms a channel connecting the upright main body, the head unit, and the pipe module; a damper that is installed in the converting duct so as to be able to change a position and causes the suction force generated from the upright main body to be transmitted to one of the head unit and the pipe module; a button that is disposed at the extension frame and is pressed by the pipe module; and a converting lever that is displaced by the button and changes a position of the damper.

Here, the damper may be rotatably installed in the converting duct and be rotated to undergo a change in position, and the channel converter may further include a cam that is connected to a shaft of the damper and is rotated by the converting lever.

Further, the damper may include a pair of hinges, each of which is formed in a sector form and has a hinge protrusion forming the shaft of the damper, a damper section that is formed in an arc shape and connects outer circumference sides of the hinges, and a sealing member that is disposed on an outer circumferential surface of the damper section.

Further, the converting duct may include a first suction channel that is connected to the head unit, a second suction channel that is connected to the connecting hose, and a discharge channel that is connected to the second housing. The damper may be rotated such that one of the first and second suction channels is connected to the discharge channel.

Further, the cam may include a cam protrusion protruding from a circumferential edge thereof. The converting lever may include a cam recess that is formed in a lower end thereof, extends in a leftward/rightward direction, and houses the cam protrusion such that the cam protrusion is movable left and right.

Further, the channel converter may further include a damper spring that elastically supports the damper such that the damper is rotated in one direction.

Further, the channel converter may further include a button spring that elastically supports the button.

Further, the converting duct may include a damper driver that forms a space in which the damper is rotatably installed. The first and second suction channels may extend from the damper driver and be formed opposite to each other such that they are partly offset.

Further, the extension frame may further include a handle that is provided at an upper portion thereof and is grasped by a user.

Further, the pipe module may include a pipe body which is formed in a hollow cylindrical shape and inside which the connecting hose is connected, and a pipe handle that is provided on one side of the pipe body so as to be graspable by a user. The button may be pressed by the pipe body.

Further, the pipe module may further include an extension pipe that is movably installed in the pipe body and protrudes from the pipe body.

Further, the extension frame may include a cover that is provided at an upper end thereof and covers an upper end of the extension pipe of the pipe module coupled to the extension frame.

Further, the extension frame may include a locking lever that is rotatably installed at an upper end thereof and locks the upper end of the extension pipe of the pipe module coupled to the extension frame.

Further, the connecting hose has one end installed on the upright main body and the other end installed inside the pipe body.

Further, one end of the connecting hose may be movably installed in the pipe body.

As described above, the vacuum cleaner according to an embodiment of the present disclosure freely rotates the extension frame in forward, backward, leftward, and rightward directions through a structure in which the wheel assembly, the first housing, and the second housing are installed, so that movement and rotation directions of the vacuum cleaner can be smoothly changed.

Further, the wheel assembly is rotated by leftward or rightward rotation of the extension frame, and thus forms an angle with the head unit, so that the vacuum cleaner can be rotated with a smaller radius of rotation.

Further, as described above, the vacuum cleaner according to another embodiment of the present disclosure couples or decouples the pipe module to or from the extension frame. Thus, a suction force generated from the fan motor of the upright main body is selectively transmitted to any one of the head unit and the pipe module.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
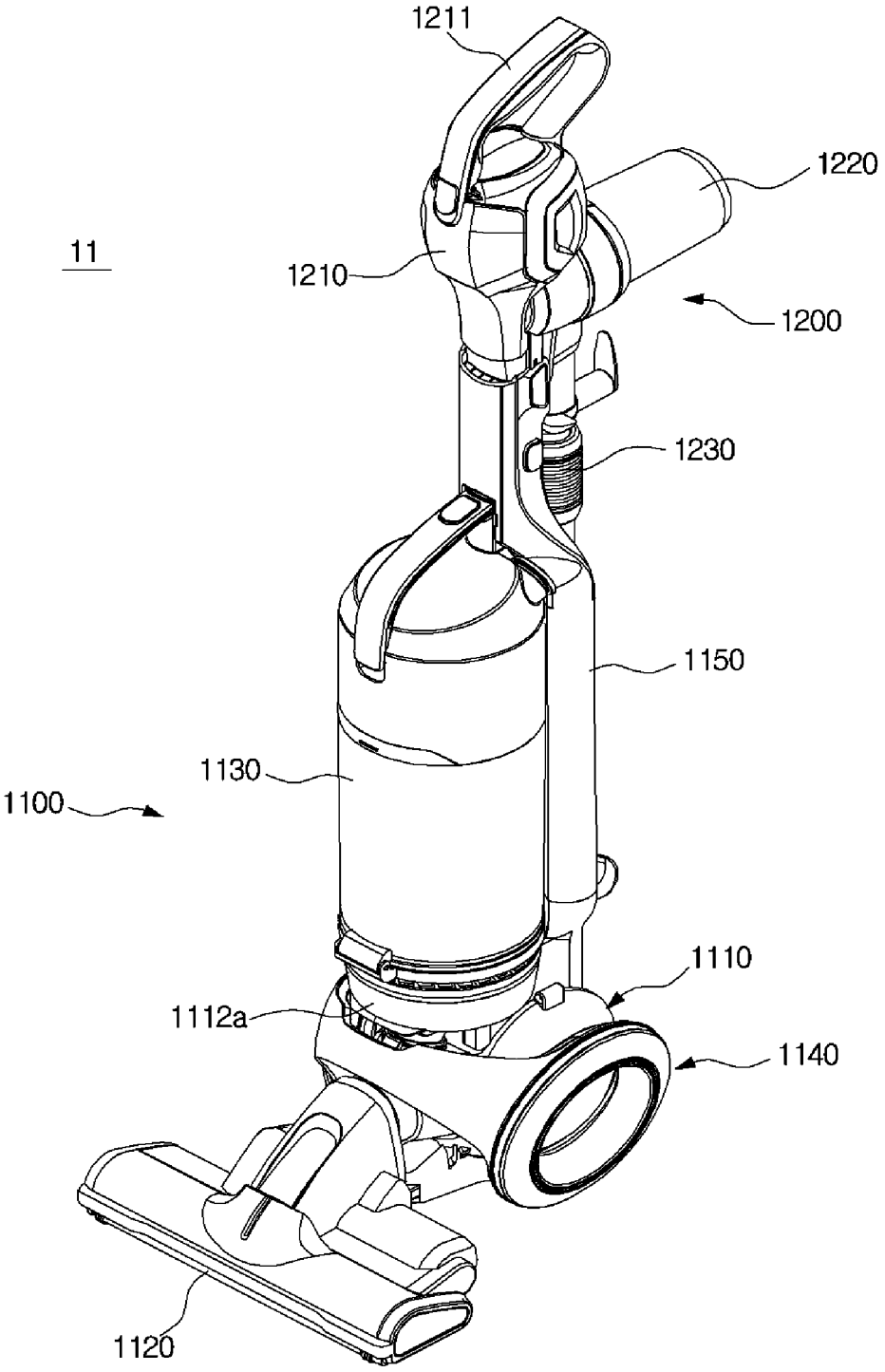
FIG. 1 is a perspective view of a vacuum cleaner according to a first embodiment of the present disclosure.

Reference will now be made in detail to the embodiments, examples of which are illustrated in the accompanying drawings, wherein like reference numerals refer to the like elements throughout. The embodiments are described below to explain the present disclosure by referring to the figures.

Hereinafter, a vacuum cleaner according to a first embodiment of the present disclosure will be described in detail with reference to the accompanying drawings.

As illustrated in FIG. 1, a vacuum cleaner 11 according to a first embodiment of the present disclosure includes an upright cleaner module 1100 enabling a user to clean a floor in an upright mode, and a handy cleaner module 1200 that is removably installed on the upright cleaner module 1100 and enables the user to do cleaning in a handy mode after being decoupled from the upright cleaner module 1100.

The upright cleaner module 1100 includes an upright main body 1110 in which an upright fan motor 1170 (see FIG. 8) generating a suction force when cleaning is done in the upright mode is housed, a head unit 1120 that is connected to a front side of the upright main body 1110, comes into contact with a floor to be cleaned, and suctions dust on the floor along with air, an upright dust collection unit 1130 that is mounted on an upper side of the upright main body 1110 and separates the dust from the air suctioned through the head unit 1120, a wheel assembly 1140 that is rotatably mounted on the upright main body 1110 and guides rotation and movement of the upright main body 1110, and an extension frame 1150 which extends upward from the upright main body 1110 and to which the handy cleaner module 1200 is removably coupled.

The handy cleaner module 1200 includes a handy main body 1210, a handy dust collection unit 1220 that is removably installed on the handy main body 1210 and collects foreign materials with the handy cleaner module 1200 decoupled from the upright cleaner module 1100, and an extension pipe 1230 that extends to have a predetermined length and enables a user to do cleaning in a separated state from a target to be cleaned. A handy fan motor (not shown) generating a suction force when the handy cleaner module 1200 does cleaning in the handy mode is housed in the handy main body 1210. A handle 1211 is provided at one side of the handy main body 1210 so as to be graspable by the user.

The upright main body 1110 includes a first housing 1111 that is installed on the wheel assembly 1140 so as to be rotatable in a leftward/rightward direction, and a second housing 1112 which is installed in the first housing 1111 so as to be rotatable in a forward/backward direction and in which the upright fan motor 1170 is housed.

In this way, the first housing 1111 is installed on the wheel assembly 1140 so as to be rotatable in the leftward/rightward direction, and the second housing 1112 is installed in the first housing 1111 so as to be rotatable in the forward/backward direction. Thereby, the extension frame 1150 installed on the second housing 1112 can be freely rotated forward and backward, and left and right by a combination of a leftward/rightward rotating operation of the first housing 1111 and a forward/backward rotating operation of the second housing 1112.

Further, the aforementioned extension frame 1150 is installed on an upper portion of the second housing 1112, and the handy cleaner module 1200 is coupled to the extension frame 1150. Thus, a user can rotate the extension frame 1150 in the forward, backward, leftward, and rightward directions by applying a force to the handle 1211 provided for the handy cleaner module 1200, and do cleaning during movement or leftward/rightward rotation of the vacuum cleaner.

Further, the upper portion of the second housing 1112 is provided with a dust collection unit mount 1112*a* for installing the upright dust collection unit 1130. The upright dust collection unit 1130 is mounted on the dust collection unit mount 1112*a*.

The head unit 1120 includes a suction port (not shown) that is provided in a lower surface thereof and allows foreign materials to be suctioned inwardly along with air by receiving the suction force generated from the upright fan motor 1170. A brush (not shown) is disposed around the suction port so as to allow a carpet to be easily cleaned. Further, the head unit 1120 includes a pair of casters (not shown) that are rotatably installed on the lower surface thereof and allow the head unit 1120 to easily move along the floor to be cleaned.

In the present embodiment, the head unit 1120 is rotatably installed at the front side of the upright main body 1110 such that the head unit 1120 can be kept supported on the floor in a stable way even when the upright main body 1110 is rotated left and right.

The head unit 1120 includes a connecting tube 1121 that extends backward, is rotatably coupled at the front side of the upright main body 1110, and transmits the suction force generated from the upright fan motor 1170 to the head unit 1120. The first housing 1111 is provided with a connector 1111*b* which protrudes forward and to which the connecting tube 1121 of the head unit 1120 is rotatably coupled.

In the present embodiment, a central axis of the connecting tube 1121 extends parallel to the floor, and the center C of rotation of the first housing 1111 is located on an extension line of the central axis of the connecting tube 1121.

This is intended to allow the head unit 1120 to be kept supported on the floor in a stable way in a process in which the first housing 1111 is rotated left and right. When configured this way, the first housing 1111 is rotated around the extension line of the central axis of the connecting tube 1121. As such, although the first housing 1111 is rotated, the head unit 1120 can be kept supported on the floor without being rotated. Thus, an interval between the floor and the lower surface of the head unit 1120 can be constantly maintained regardless of an angle of rotation of the first housing 1111. Conversely, when the first housing 1111 is not configured this way, a force applied to rotate the first housing 1111 is partly transmitted to the head unit 1120, and the left or right side of the head unit 1120 can be raised by the rotation of the first housing 1111.

The upright dust collection unit 1130 receives the air suctioned by the head unit 1120, separates dust included in the air, and collects the separated dust. The upright dust collection unit 1130 is removably installed on the dust collection unit mount 1112*a* and the extension frame 1150 such that the user can decouple the upright dust collection unit 1130 from the upright main body 1110 and clean the decoupled upright dust collection unit 1130.

Figure 2:
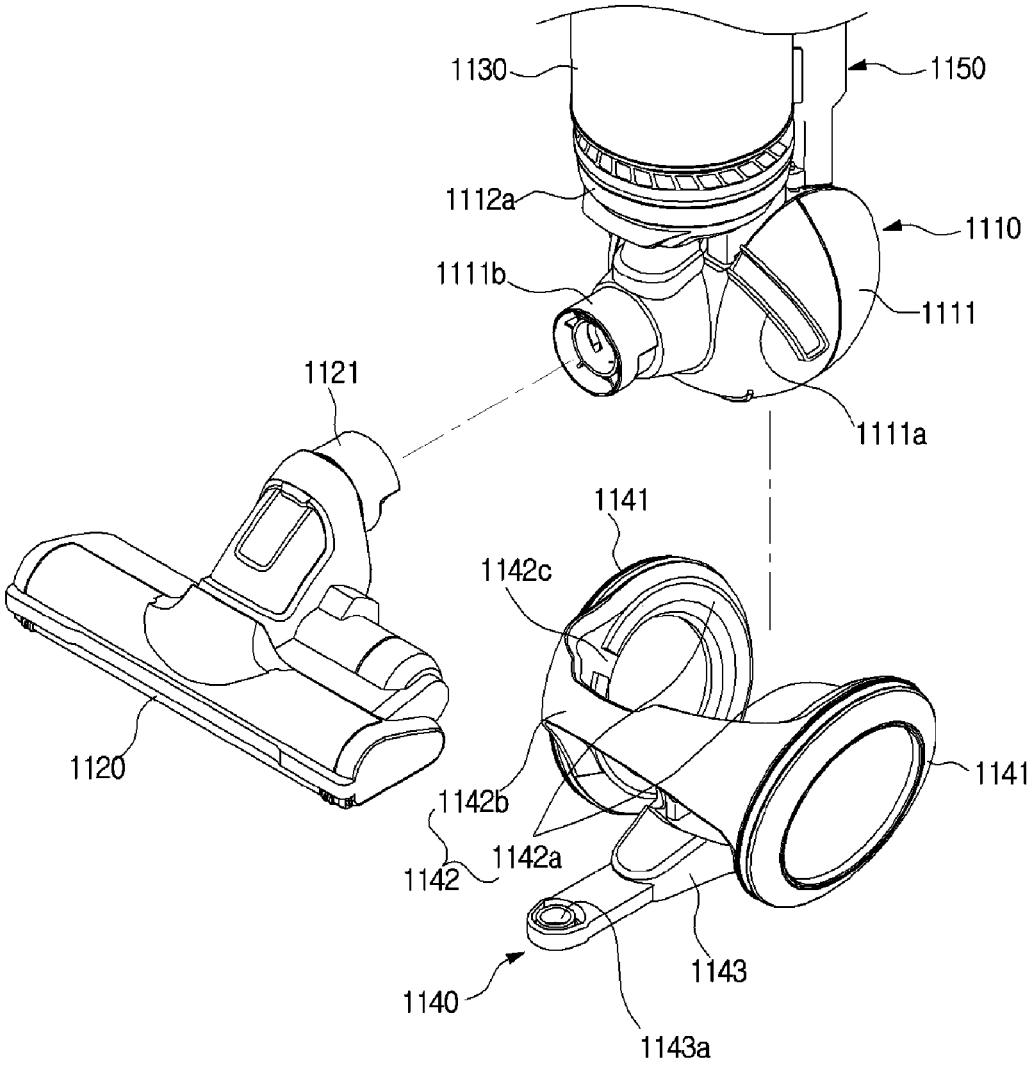
FIGS. 2 and 3 are exploded perspective views illustrating coupling of an upright main body and a wheel assembly in the vacuum cleaner according to the first embodiment of the present disclosure.
Figure 3:
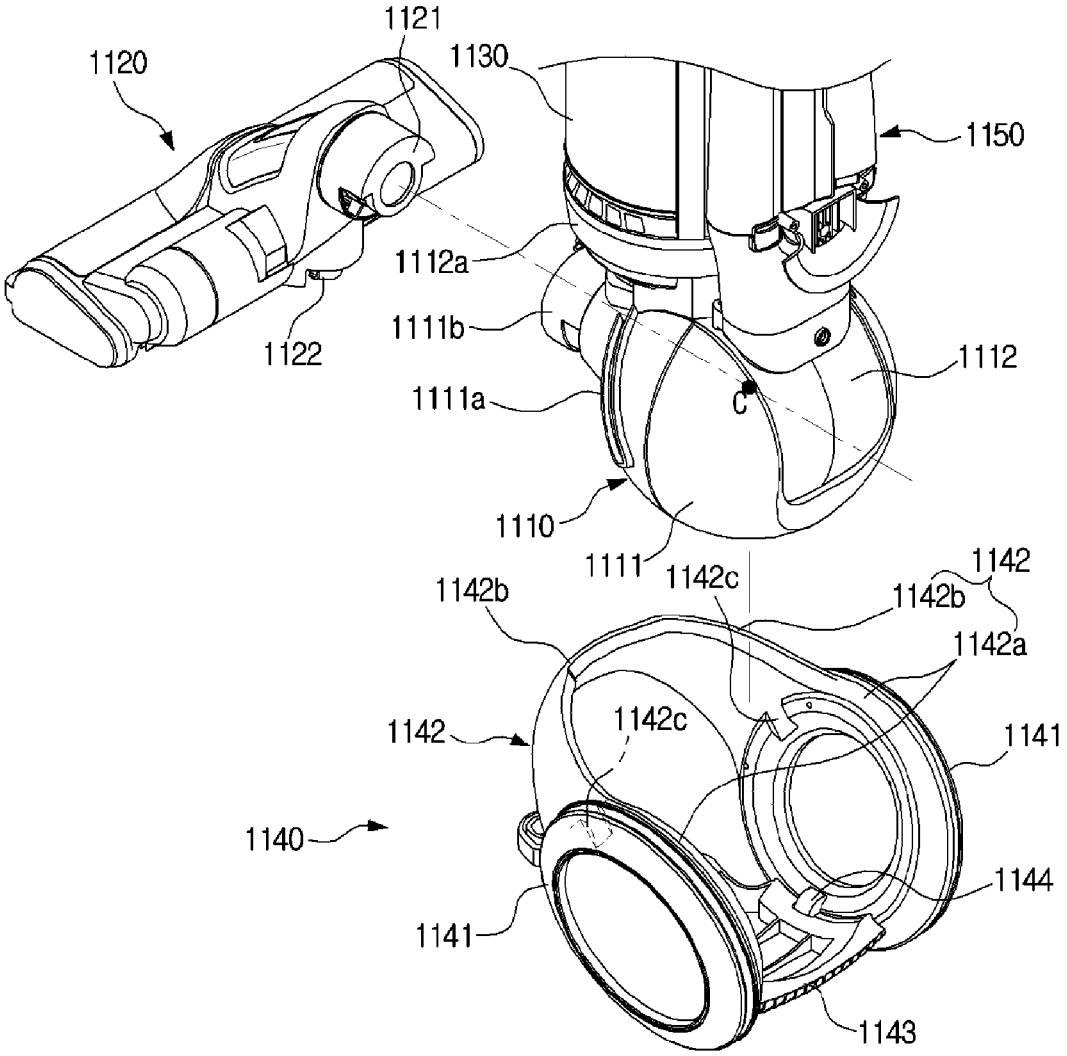

As illustrated in FIGS. 2 and 3, the wheel assembly 1140 includes a pair of wheels 1141 disposed on both left and right sides thereof, and a wheel bracket 1142 on which the two wheels 1141 are rotatably installed, and which rotatably supports the upright main body 1110.

The two wheels 1141 are each formed in an annular shape, and are rotatably installed on the wheel bracket 1142. The wheel bracket 1142 includes a pair of wheel mounts 1142*a* on which the two wheels 1141 are rotatably installed, and arc sections 1142*b* which are formed in an arc shape and connect front upper sides of the two wheel mounts 1142*a*.

Further, the wheel assembly 1140 includes a support bracket 1143 coupled to a lower portion of the wheel bracket 1142. The support bracket 1143 functions to allow the aforementioned head unit 1120 to be rotatably coupled to the wheel assembly 1140 and to allow the two wheel mounts 1142*a* to be kept spaced apart from each other. A front side of the support bracket 1143 is provided with a hinge recess 1143*a* into which the head unit 1120 is rotatably fitted. The head unit 1120 is provided with a hinge protrusion 1122 that is rotatably fitted into the hinge recess 1143*a*.

The first housing 1111 of the upright main body 1110 is installed inside the wheel assembly 1140 so as to be rotatable in the leftward/rightward direction.

Figure 4:
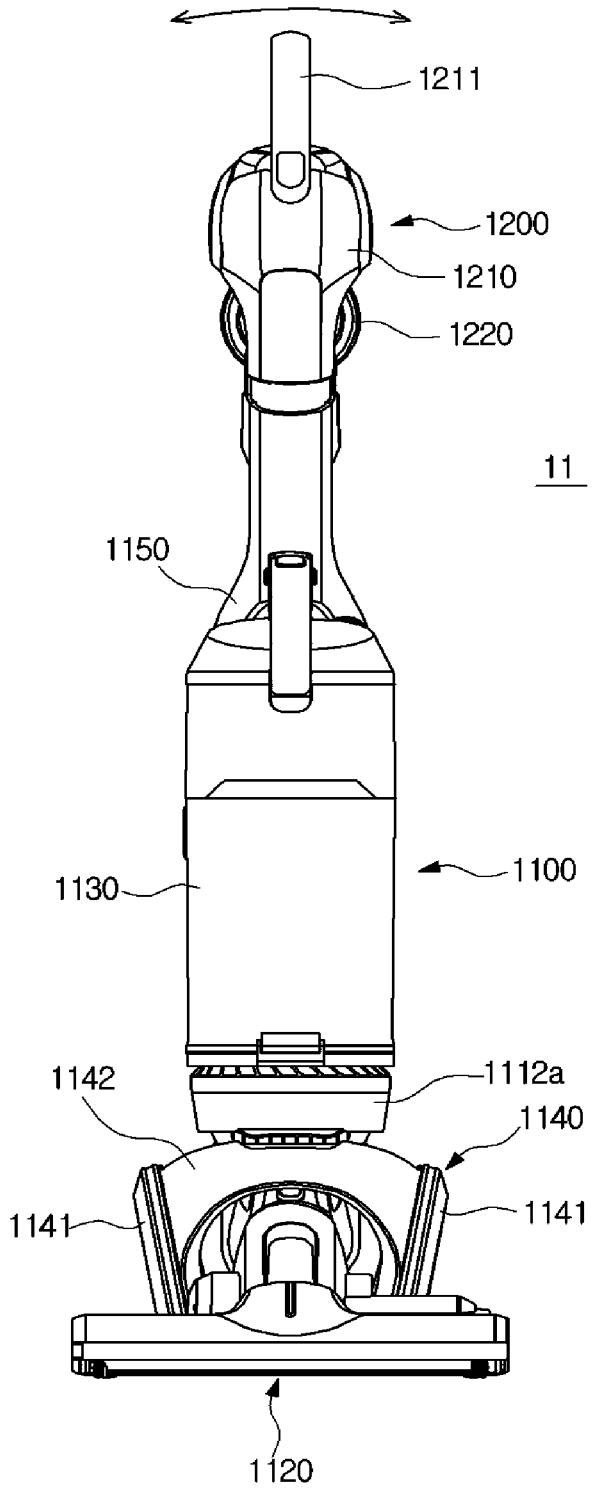
FIG. 4 is a front view of the vacuum cleaner according to the first embodiment of the present disclosure.
Figure 5:
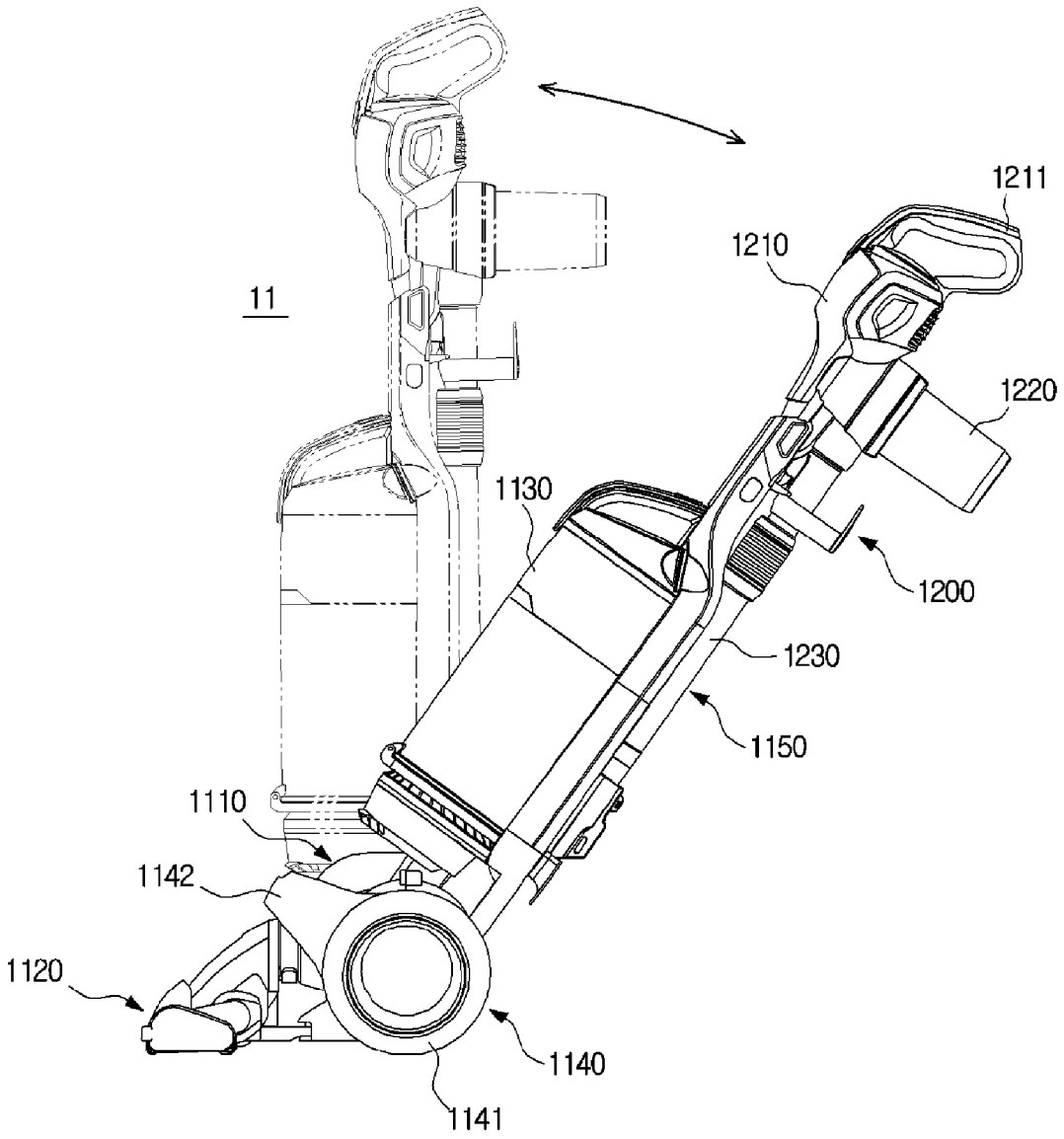
FIG. 5 is a side view illustrating a forward/backward rotating operation of the vacuum cleaner according to the first embodiment of the present disclosure.
Figure 6:
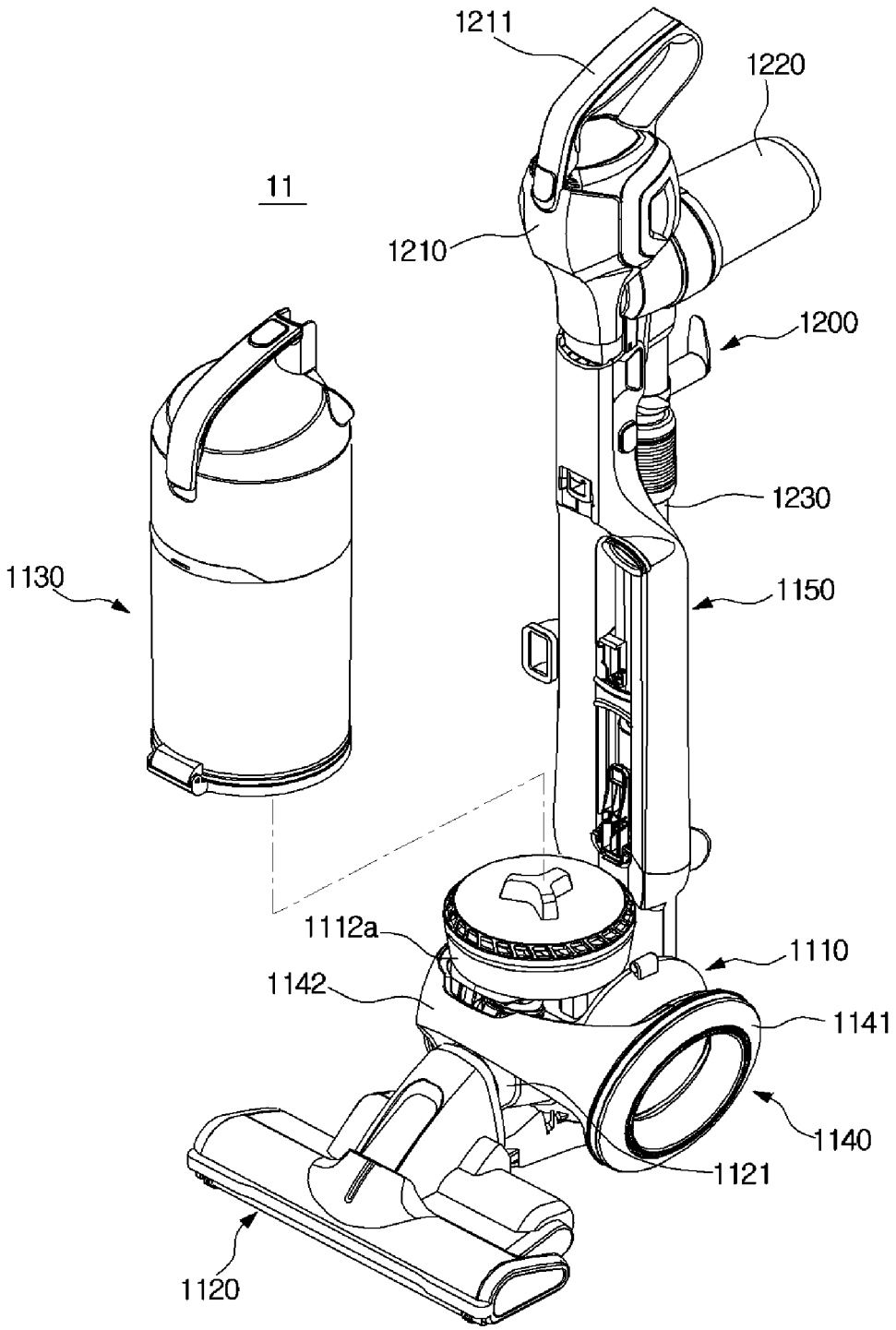
FIG. 6 is an exploded perspective view illustrating a state in which an upright dust collection unit is separated in the vacuum cleaner according to the first embodiment of the present disclosure.

Here, the two wheels 1141 are installed on the wheel mounts 1142*a* so as to have positive (+) camber. As illustrated in FIG. 4, the two wheels 1141 are installed such that an interval between lower portions thereof is narrower than that between upper portions thereof. This is intended to reduce the interval between the lower portions of the two wheels 1141 to allow the wheel assembly 1140 to be rotated with a smaller radius of rotation. In the present embodiment, a camber angle of each wheel 1141 is, but is not limited to, 10 degrees. The camber angle may be formed within a range from 5 to 20 degrees.

Further, the wheel assembly 1140 includes a pair of rollers 1144 that come into contact with an outer surface of the first housing 1111 while rolling such that the first housing 1111 is guided to enable easy rotation. In the present embodiment, the rollers 1144 are each installed on a joint between the support bracket 1143 and the wheel bracket 1142.

The upright main body 1110 is provided with a pair of guide rails 1111*a*, on both left and right sides thereof, which extend inclined toward a rear lower side thereof, and the wheel bracket 1142 is provided with a pair of guides 1142*c*, on both sides thereof, in which the guide rails 1111*a* are movably guided. Thus, as the first housing 1111 is rotated left and right through the extension frame 1150, the two guides 1142*c* of the wheel bracket 1142 moves along the two guide rails 1111*a*. In the meantime, one of both sides of the wheel bracket 1142 is pushed to the front side, and the other is pulled to the rear side, so that the wheel assembly 1140 is horizontally rotated left and right. In the present embodiment, each guide rail 1111*a* is formed by a pair of ribs spaced apart from and parallel to each other.

In the present embodiment, the first housing 1111 is formed in a spherical shape at both sides of the front thereof, and the aforementioned guide rails 1111*a* are formed at the both front sides of the first housing 1111 formed in the spherical shape. The guides 1142*c* are recessed inside the wheel mounts 1142*a* of the wheel bracket 1142.

Here, the center of the spherical shape in which the first housing 1111 is formed to correspond to the center of rotation of the first housing 1111, and the center of rotation of the wheel assembly 1140 and the center of rotation of the first housing 1111 are adapted to be identical to each other.

The guide rails 1111*a* and the guides 1142*c* are intended to cause the head unit 1120 to form a fixed angle with the wheel assembly 1140 when the upright main body 1110 is rotated in the leftward/rightward direction.

In other words, when the upright main body 1110 is rotated right in an upright position, the wheel assembly 1140 is horizontally rotated left, and the head unit 1120 is rotated right relative to the wheel assembly 1140. When the upright main body 1110 is rotated left, the wheel assembly 1140 is rotated right, and the head unit 1120 is rotated left relative to the wheel assembly 1140. In other words, when the upright main body 1110 is rotated left or right, the head unit 1120 is rotated relative to the wheel assembly 1140 in a direction corresponding to the rotational direction of the upright main body 1110, so that the vacuum cleaner can be moved with a smaller radius of rotation.

In the present embodiment, the guide rails 1111*a* protrude from the first housing 1111, and the guides 1142*c* are recessed in the wheel bracket 1142. However, the present embodiment is not limited to this configuration. Conversely, the guide rails 1111*a* may be recessed in the first housing 1111, and the guides 1142*c* may protrude from the wheel bracket 1142. The guide rails 1111*a* and the guides 1142*c* may be variously changed in position, number, and thickness according. The guide rails 1111*a* may be variously changed in angle.

As illustrated in FIG. 1, the extension frame 1150 is adapted to receive a force from the handle 1211 with the upright main body 1110 spaced apart from the handle 1211. The extension frame 1150 enables a user to apply a force to the upright main body 1110 even while standing so as to be able to rotate and move the upright main body 1110. Further, the extension frame 1150 functions to removably support the aforementioned upright dust collection unit 1130.

Figure 7:
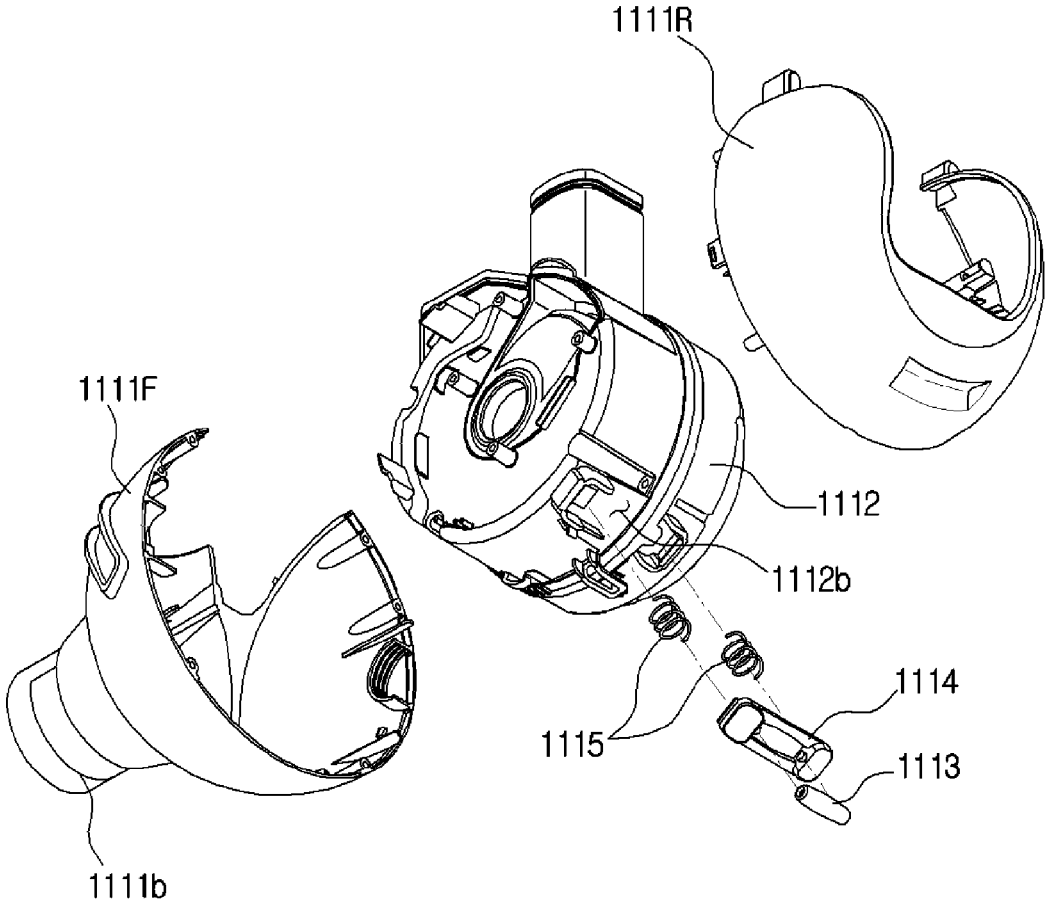
FIG. 7 is an exploded perspective view of the upright main body in the vacuum cleaner according to the first embodiment of the present disclosure.

As illustrated in FIG. 7, the upright main body 1110 includes a locking jaw 1111*d* protruding from an inner surface of the first housing 1111, a locking member 1113 that is formed in a roller shape, is elastically supported on the second housing 1112, moves along the inner surface of the first housing 1111, and is selectively locked by the locking jaw 1111*d* according to a position, a locking bracket 1114 in which the locking member 1113 is rotatably installed, and a pair of locking springs 1115, one end of each of which is supported on the second housing 1112, and the other end is supported on the locking bracket 1114. An outer surface of the second housing 1112 is provided with a locking member mount 1112*b* in which the locking springs 1115 are housed and in which the locking member 1113 and the locking bracket 1114 are movably installed. In the present embodiment, the locking member 1113 is formed of a cylindrical roller, and is adapted to be able to easily move along the inner surface of the first housing 1111.

The first housing 1111 is formed by front and rear housings 1111F and 1111R coupled in forward and backward directions, and the aforementioned locking jaw 1111 protrudes from an inner surface of the rear housing 1111R.

Figure 8:
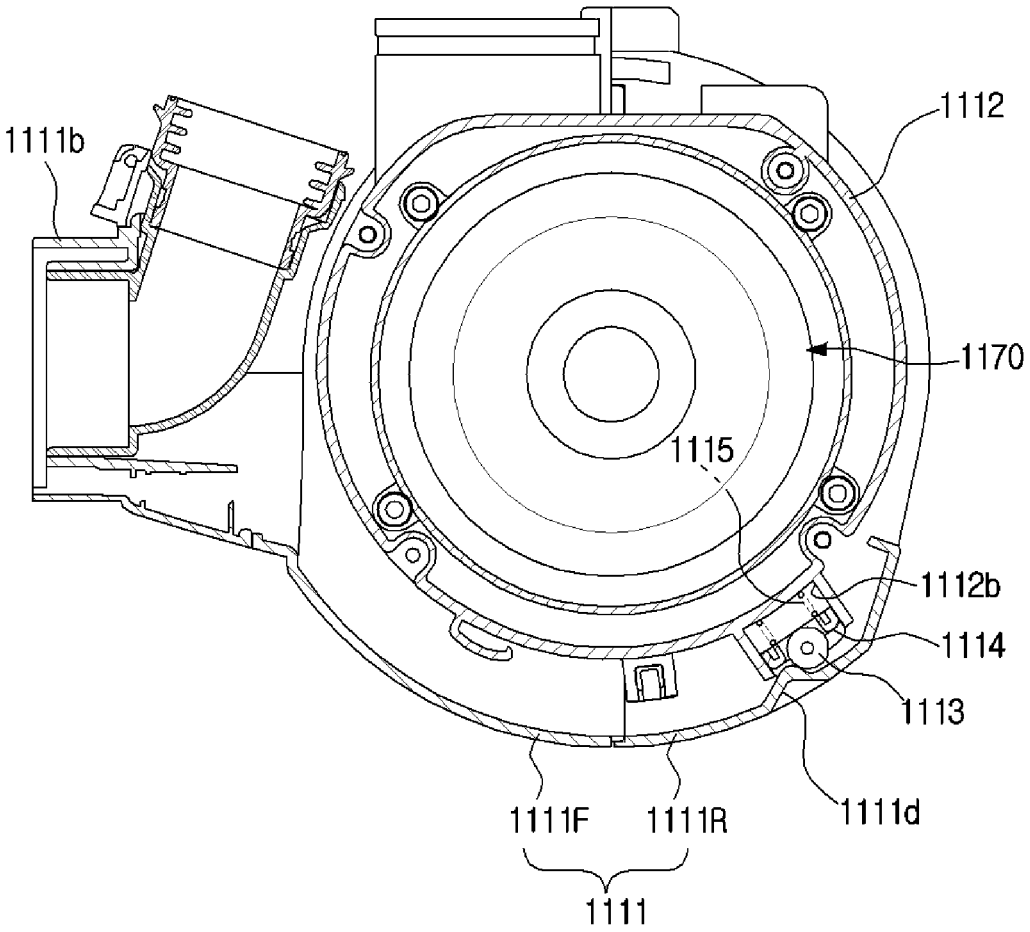
FIGS. 8 and 9 are side cross-sectional views illustrating an operation of a locking member in the vacuum cleaner according to the first embodiment of the present disclosure.
Figure 9:
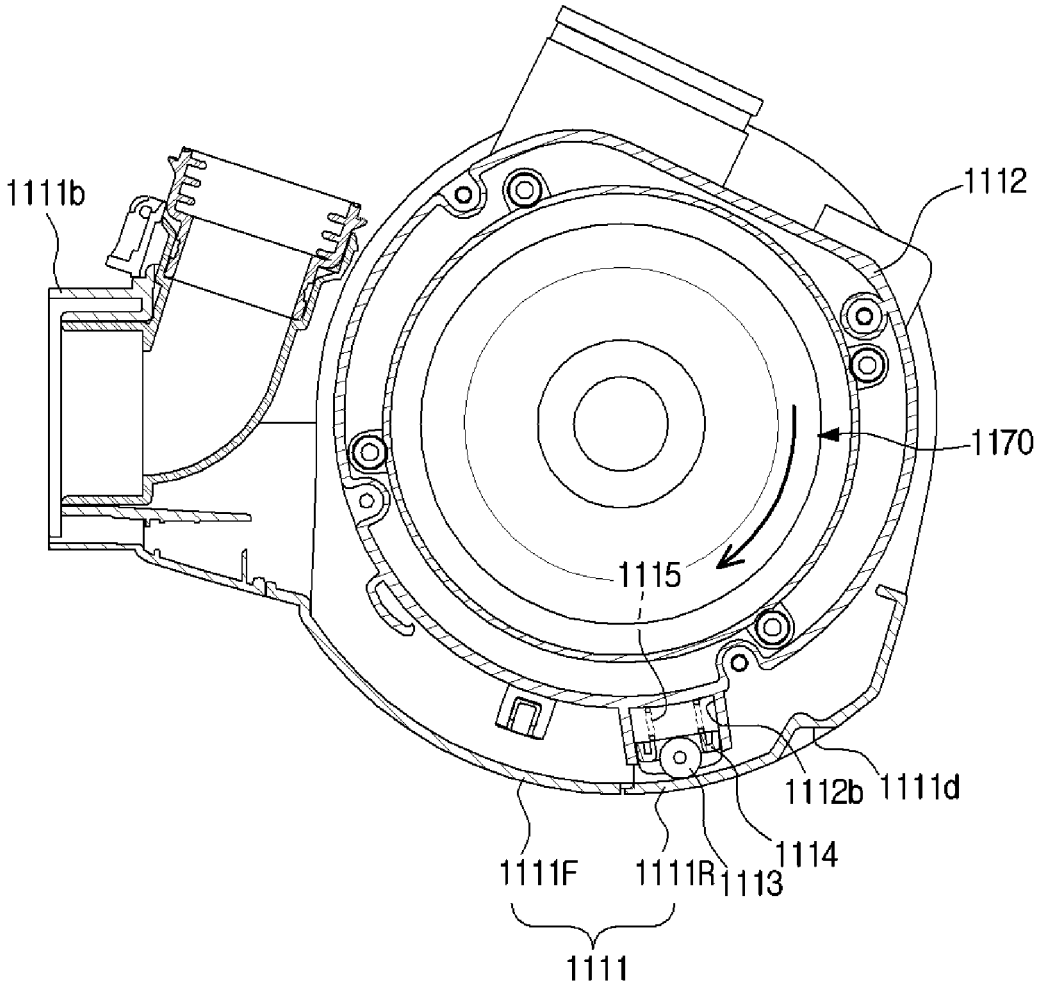

This structure is intended to allow the extension frame 1150 to be kept disposed vertically until a force having a fixed level or more is applied to the handle 1211 by a user. As illustrated in FIG. 8, the locking member 1113 is kept locked by the locking jaw 1111*d* with the extension frame 1150 disposed vertically. When the user applies a force having a fixed level or more to the second housing 1112 through the handle 1211 and the extension frame 1150 and rotates the second housing 1112, the locking member 1113 passes through the locking jaw 1111*d* as illustrated in FIG. 9 while the locking springs 1115 are elastically deformed and restored. Accordingly, the second housing 1112 can be freely rotated in a backward direction.

Thus, the second housing 1112 is not rotated due to the locking member 1113 locked by the locking jaw 1111*d* until the force having the fixed level or more is applied to the second housing 1112 by the user, and the extension frame 1150 is still disposed vertically. Further, when the force having the fixed level or more is applied to the second housing 1112 by the user, the locking member 1113 rolls over the locking jaw 1111*d* and moves along the inner surface of the first housing 1111, so that the extension frame 1150 can be rotated.

In the present embodiment, the locking member 1113 is formed of, but not limited to, a roller. The locking member may be formed of various members that can be elastically deformed, such as a leaf spring. Further, in the present embodiment, the locking jaw 1111*d* is provided for the inner surface of the first housing 1111, and the locking member 1113 is installed on the outer surface of the second housing 1112. Conversely, the locking member 1113 may be installed on the inner surface of the first housing 1111, and the locking jaw 1111*d* may be provided for the outer surface of the second housing 1112.

Next, an operation of the vacuum cleaner configured in this way will be described with reference to the drawings.

Figure 10:
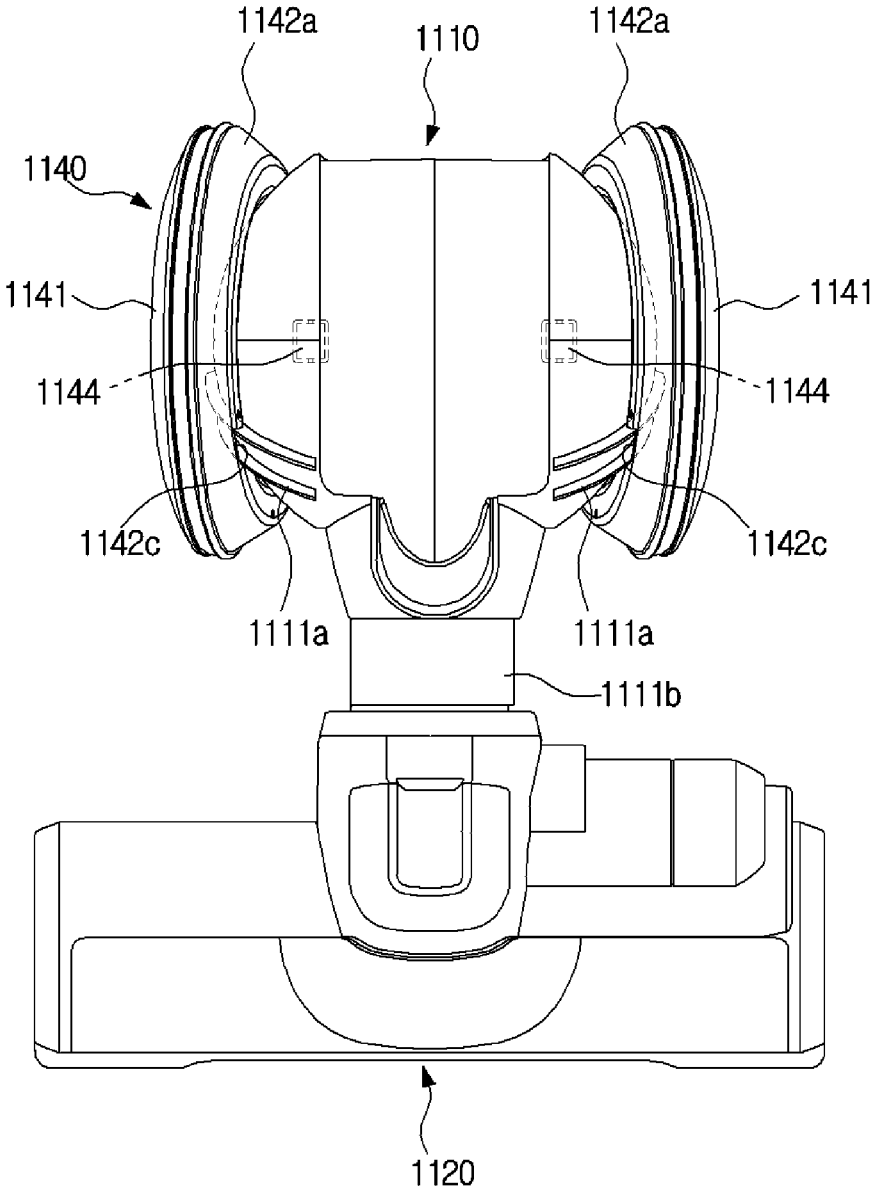
FIGS. 10 to 12 are plan views illustrating operations of the wheel assembly and a head unit according to rotation of the upright main body in the vacuum cleaner according to the first embodiment of the present disclosure.

First, as illustrated in FIG. 10, when the user grasps the handle 1211 to rotate the upright main body 1110 to a right side in an upright position in a state in which the upright main body 1110 is not rotated, a right side of the wheel assembly 1140 moves forward due to the guide rail 1111*a* provided at a right side of the upright main body 1110, and a left side of the wheel assembly 1140 moves backward due to the guide rail 1111*a* provided at a left side of the upright main body 1110. Thus, the wheel assembly 1140 is horizontally rotated to the left side opposite to the rotational direction of the upright main body 1110.

Figure 11:
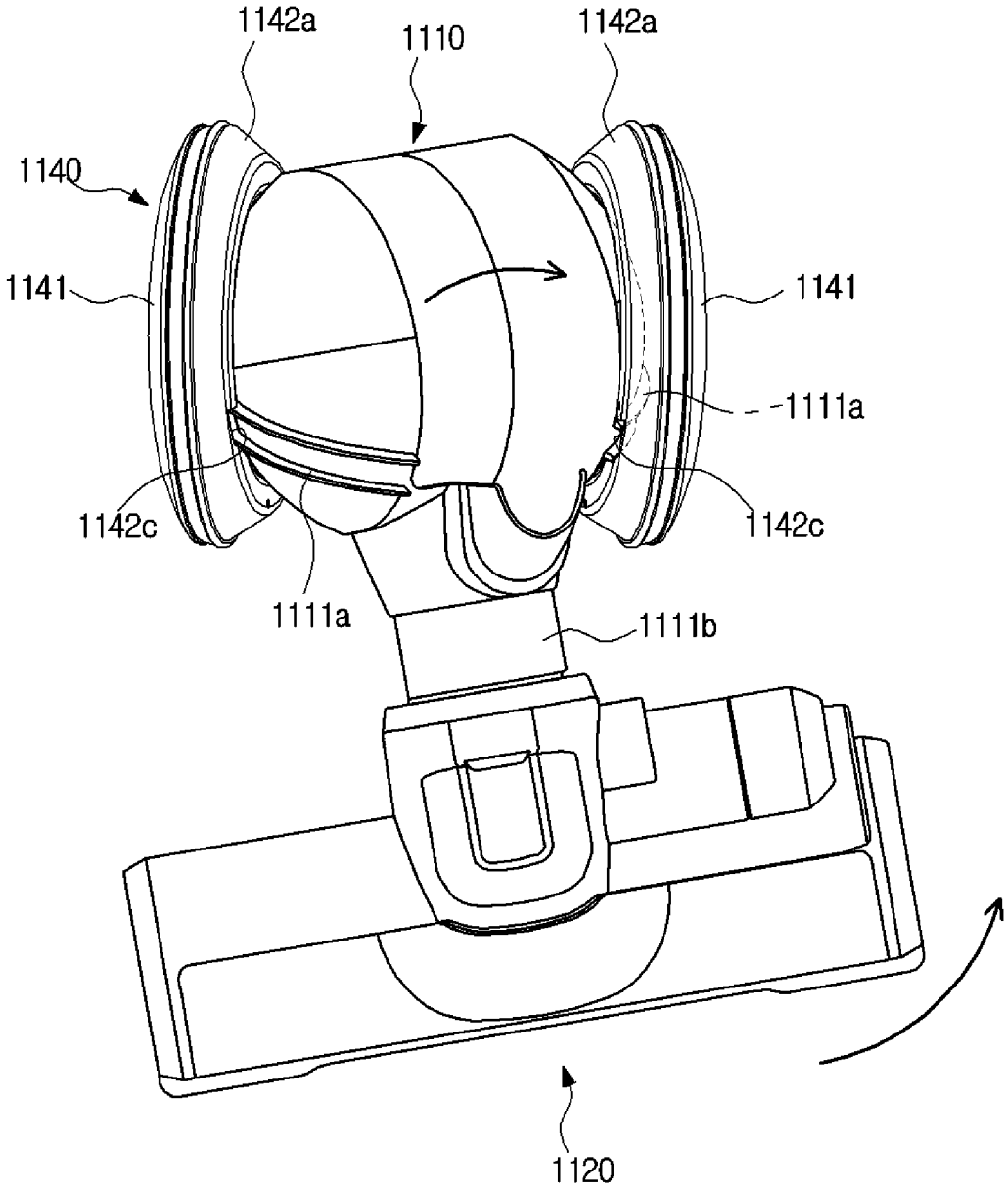

Here, when this operation is considered on the basis of the wheel assembly 1140, i.e. when it is assumed that the wheel assembly 1140 is fixed, the upright main body 1110 and the head unit 1120 connected to the upright main body 1110 are horizontally rotated around the wheel assembly 1140 to the right side as illustrated in FIG. 11. That is, when the upright main body 1110 is rotated to the right side in an upright position, the head unit 1120 is horizontally rotated around the wheel assembly 1140 to the right side at the same time.

In contrast, as illustrated in FIG. 10, when the user grasps the handle 1211 to rotate the upright main body 1110 to a left side in an upright position in a state in which the upright main body 1110 is not rotated, the right side of the wheel assembly 1140 moves backward due to the guide rail 1111*a* provided at the right side of the upright main body 1110, and the left side of the wheel assembly 1140 moves forward due to the guide rail 1111*a* provided at the left side of the upright main body 1110. Thus, the wheel assembly 1140 is horizontally rotated to the right side opposite to the rotational direction of the upright main body 1110.

Figure 12:
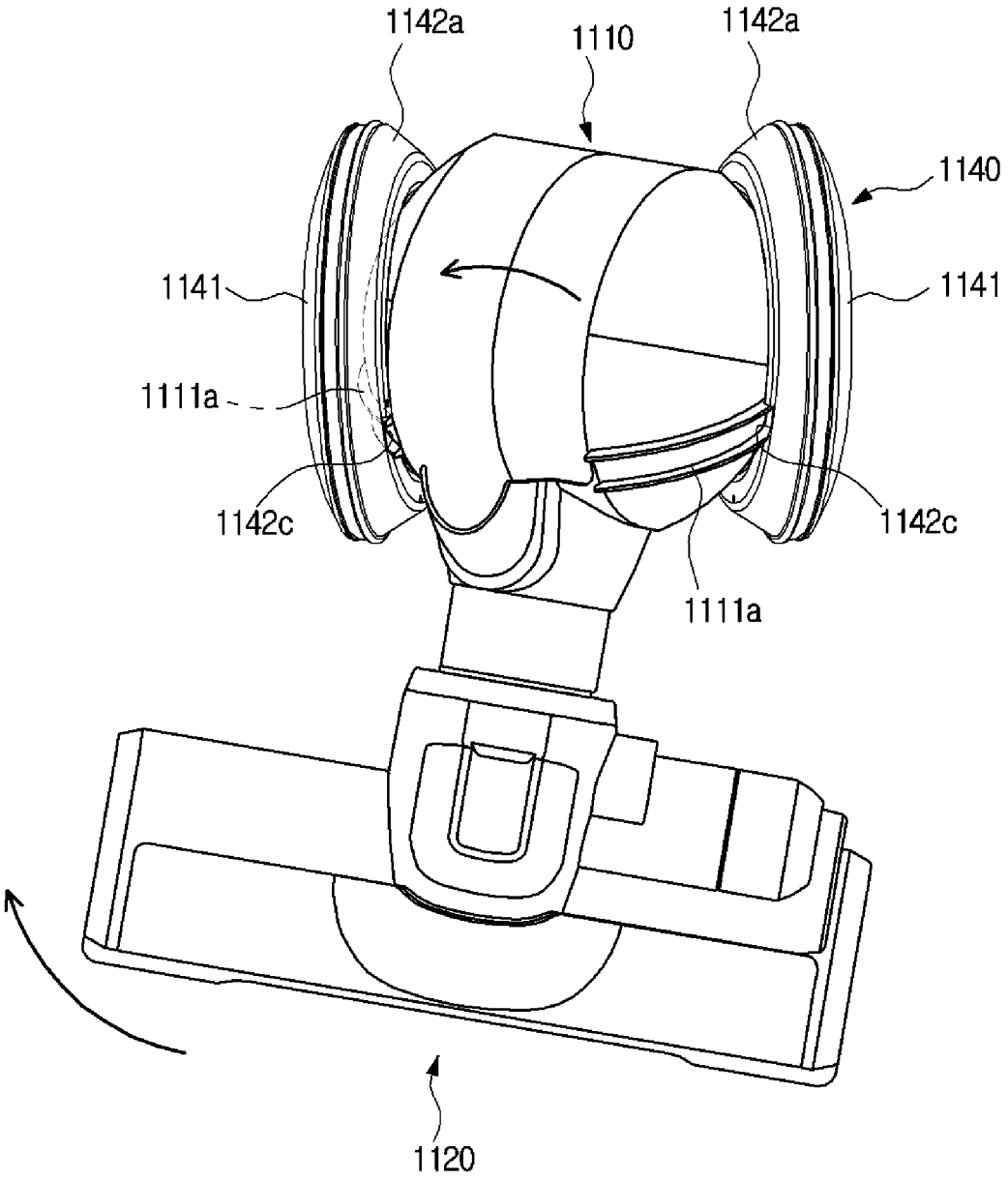

Here, when this operation is considered on the basis of the wheel assembly 1140, i.e. when it is assumed that the wheel assembly 1140 is fixed, the upright main body 1110 and the head unit 1120 connected to the upright main body 1110 are horizontally rotated around the wheel assembly 1140 to the left side as illustrated in FIG. 12. That is, when the upright main body 1110 is rotated to the left side in an upright position, the head unit 1120 is horizontally rotated around the wheel assembly 1140 to the left side.

As described above, when the head unit 1120 is rotated left or right relative to the wheel assembly 1140 and forms a predetermined angle with the wheel assembly 1140, the vacuum cleaner can be rotated with a smaller radius of rotation.

In the present embodiment, the vacuum cleaner includes the guide rails 1111*a* and the guides 1142*c*, and is configured such that the wheel assembly 1140 is rotated left or right to form an angle with the head unit 1120 by the rotation of the first housing 1111. This is intended to further reduce the rotational radius of the vacuum cleaner, and is not essential.

Figure 13:
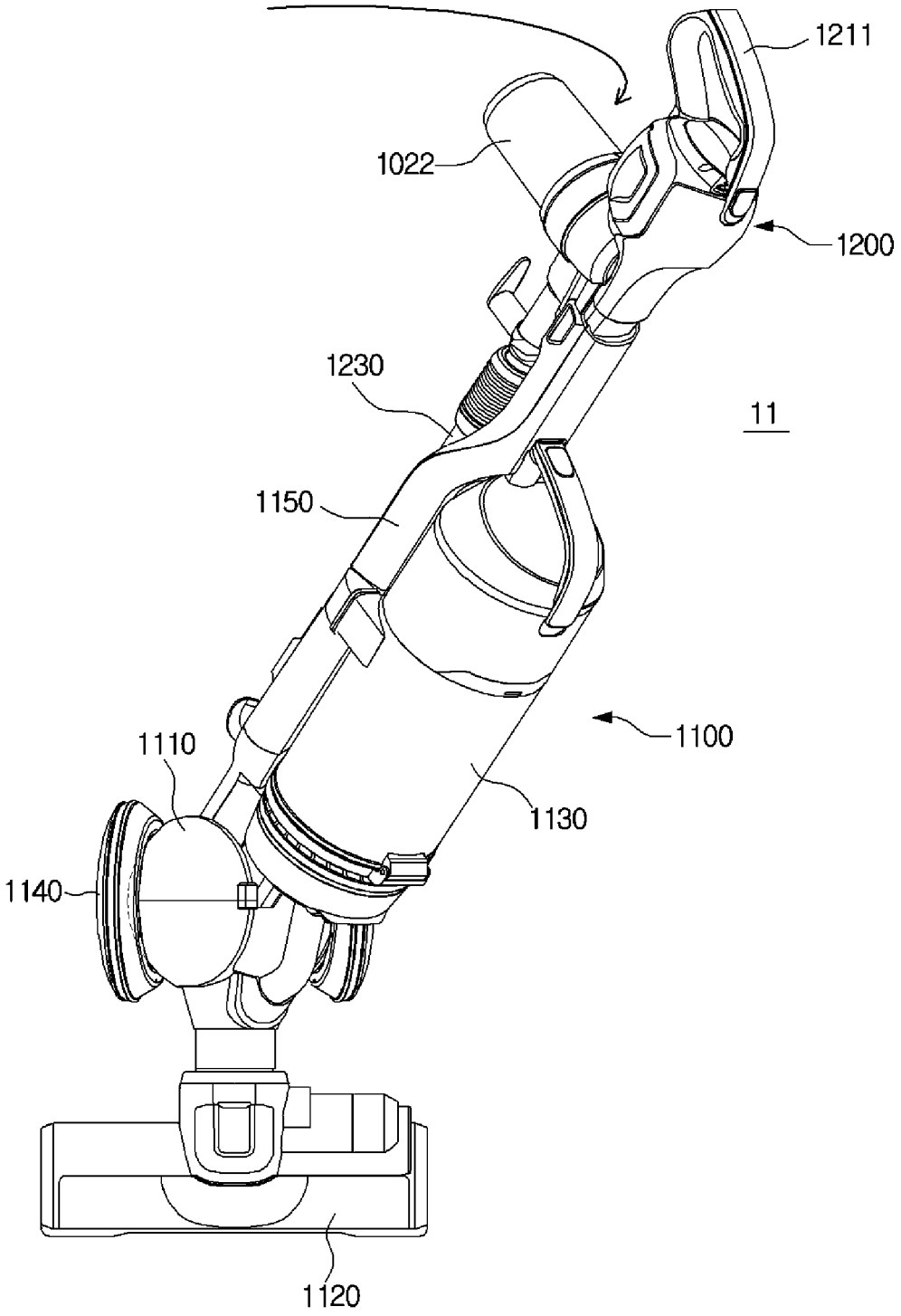
FIGS. 13 and 14 are plan views illustrating operations of a wheel assembly and a head unit according to rotation of an extension frame in a vacuum cleaner according to a second embodiment of the present disclosure.
Figure 14:
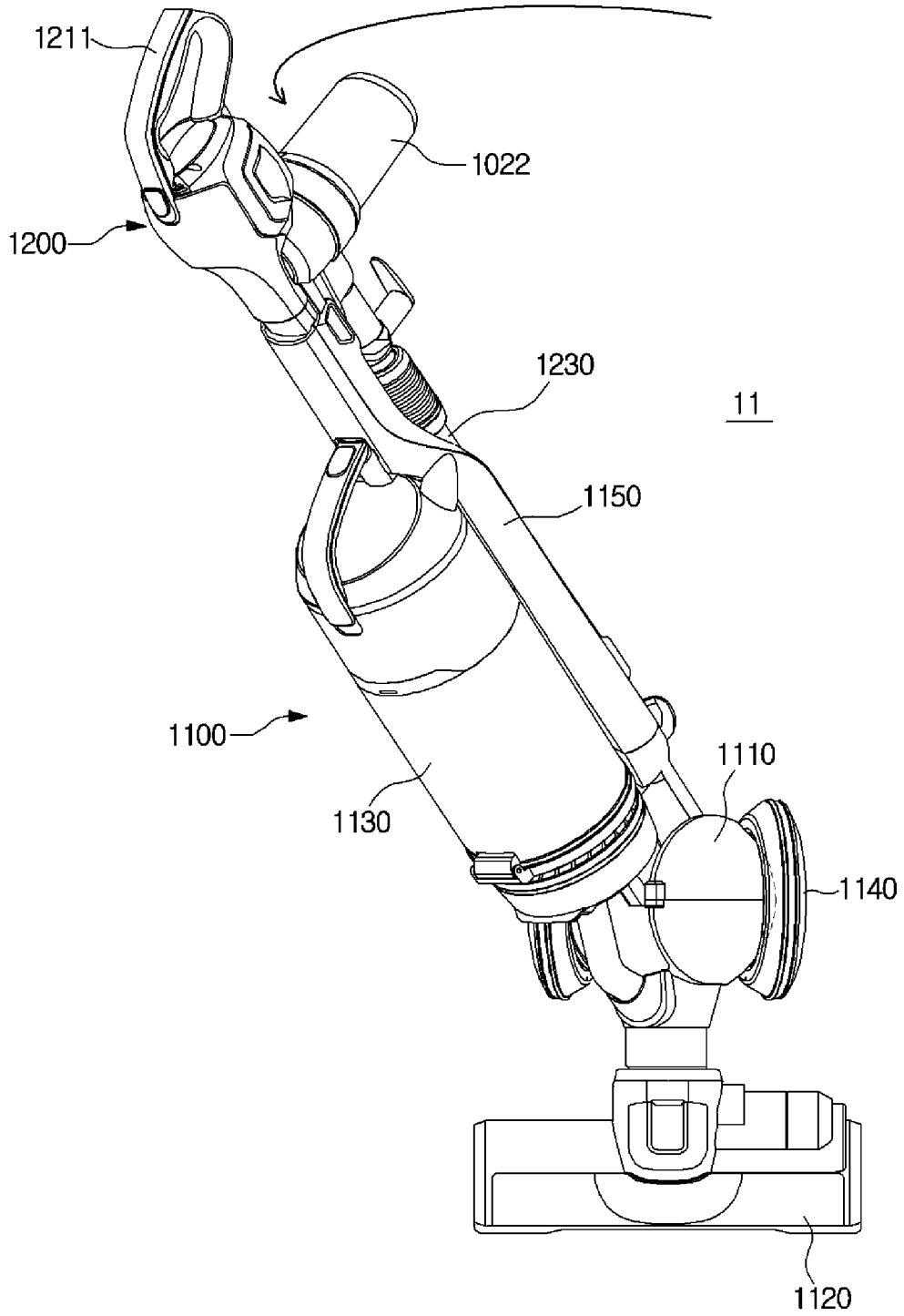

That is, a second embodiment of the present disclosure as illustrated in FIGS. 13 and 14 can obtain an effect of reducing the rotational radius of the vacuum cleaner without configurations corresponding to the guide rails 1111*a* and the guides 1142*c*.

In detail, as illustrated in the figures, when the user rotates the extension frame 1150 to the left or right side with the extension frame 1150 inclined toward a rear upper side, the extension frame 1150 and the head unit 1120 form an angle due to the leftward/rightward rotation of the extension frame 1150. Thereby, the rotational radius of the vacuum cleaner is reduced. In this case, the head unit 1120 is preferably fixedly installed at the front side of the wheel assembly 1140.

Hereinafter, a vacuum cleaner according to a third embodiment of the present disclosure will be described in detail with reference to the drawings.

Figure 15:
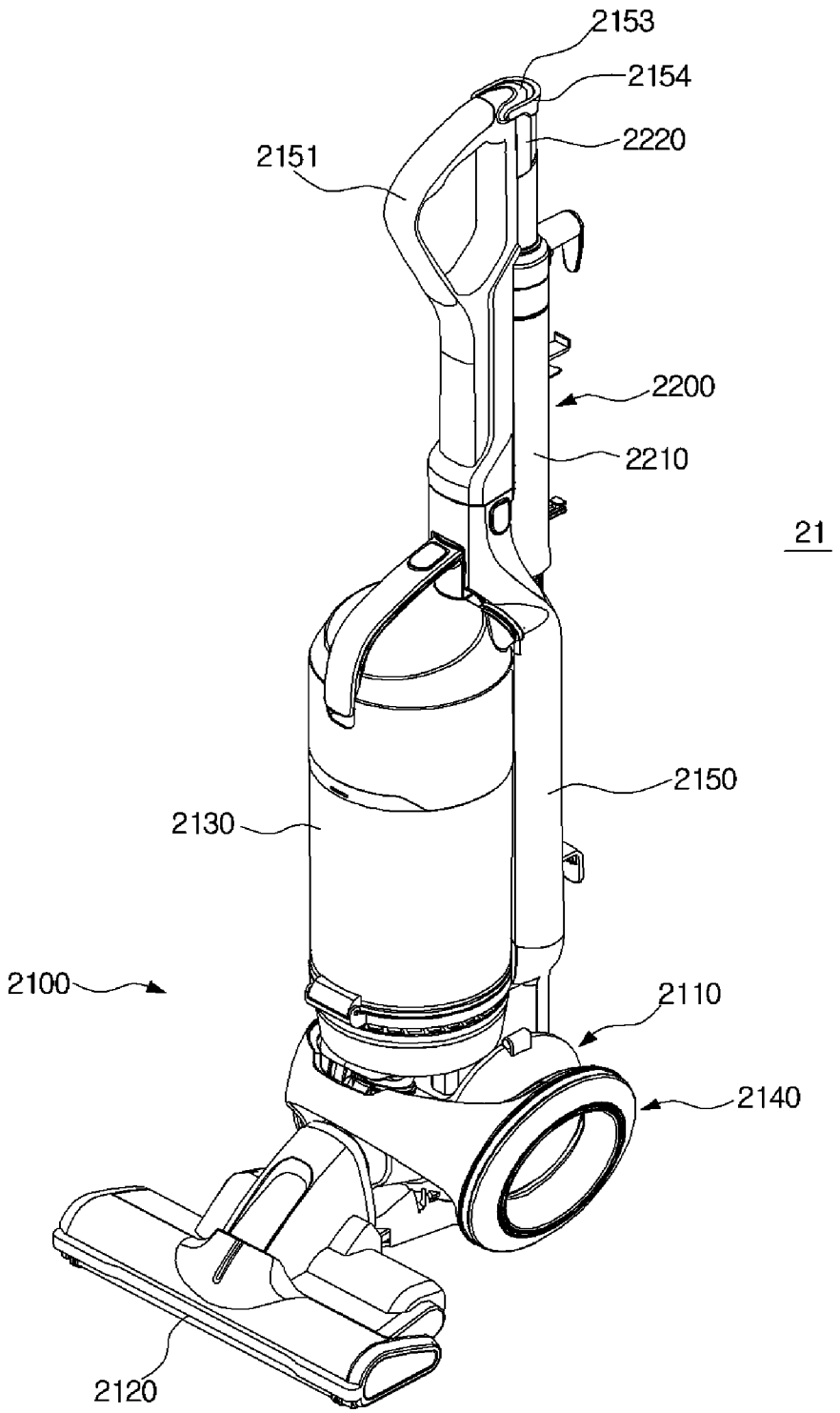
FIG. 15 is a perspective view illustrating a state in which an upright cleaner module and a pipe module are coupled in a vacuum cleaner according to a third embodiment of the present disclosure.
Figure 16:
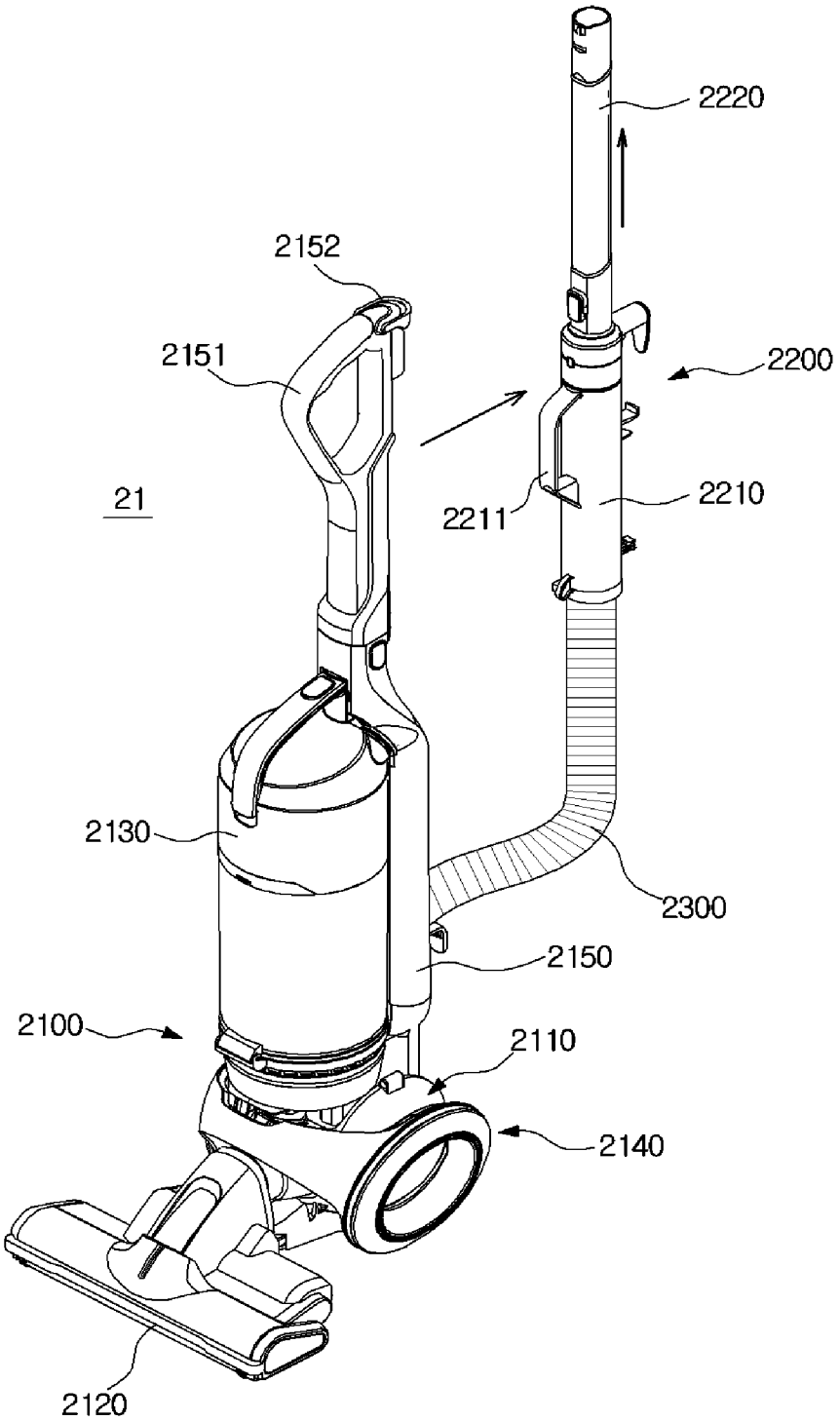
FIG. 16 is a perspective view illustrating a state in which the upright cleaner module and the pipe module are decoupled in the vacuum cleaner according to the third embodiment of the present disclosure.

As illustrated in FIGS. 15 and 16, a vacuum cleaner 21 according to a third embodiment of the present disclosure includes an upright cleaner module 2100 enabling a user to clean a floor, a pipe module 2200 that is removably installed on the upright cleaner module 2100 and enables the user to clean various places which the upright cleaner module 2100 cannot clean after being decoupled from the upright cleaner module 2100, and a connecting hose 2300 that connects the upright cleaner module 2100 and the pipe module 2200 and causes a suction force generated from the upright cleaner module 2100 to be transmitted to the pipe module 2200.

The upright cleaner module 2100 includes an upright main body 2110 in which a fan motor (not shown) generating a suction force when a floor is cleaned is housed, a head unit 2120 that is connected to a front side of the upright main body 2110, comes into contact with the floor to be cleaned, and suctions dust on the floor along with air, a dust collection unit 2130 that is mounted on an upper side of the upright main body 2110 and separates the dust from the air suctioned through the head unit 2120, a wheel assembly 2140 that is rotatably mounted on the upright main body 2110 and guides rotation and movement of the upright main body 2110, and an extension frame 2150 which extends upward from the upright main body 2110 and to which the pipe module 2200 is removably coupled.

The pipe module 2200 includes a pipe body 2210 which is formed in a hollow cylindrical shape and in which the connecting hose 2300 is fixed, and an extension tube 2220 that extends to have a predetermined length, is movably installed on the pipe body 2210, and protrudes from the pipe module 2200.

The connecting hose 2300 is formed of a bellows tube whose length is increased or decreased within a predetermined range. A lower end of the connecting hose 2300 is connected to the upright main body 2110, and an upper end of the connecting hose 2300 is connected to the pipe module 2200.

In the upright cleaner module 2100, the upright main body 2110 includes a first housing 2111 that is installed on the wheel assembly 2140 so as to be rotatable in a leftward/rightward direction, and a second housing 2112 (see FIG. 18) which is installed in the first housing 2111 so as to be rotatable in a forward/backward direction and in which the fan motor is housed. The dust collection unit 2130 is installed at an upper portion of the second housing 2112, and a channel converter 2160 to be described below is disposed at a rear side of the second housing 2112. A lower end of the extension tube 2220 is connected to the second housing 2112 through the channel converter 2160.

The head unit 2120 includes a suction port (not shown) that is provided in a lower surface thereof and allows foreign materials to be suctioned inwardly along with air by receiving the suction force generated from the fan motor. A brush (not shown) is disposed around the suction port so as to allow a carpet to be easily cleaned. Further, the head unit 2120 includes a pair of casters (not shown) that are rotatably installed on the lower surface thereof and allow the head unit 1120 to easily move along the floor to be cleaned.

In the present embodiment, the head unit 2120 is rotatably installed at the front side of the upright main body 2110 such that the head unit 2120 can be kept supported on the floor in a stable way even when the upright main body 2110 is rotated left and right.

The dust collection unit 2130 receives the air suctioned by the head unit 2120 or the pipe module 2200, separates dust included in the air, and collects the separated dust. The dust collection unit 2130 is removably installed on the upright main body 2110 and the extension frame 2150 such that the user can decouple the dust collection unit 2130 from the upright main body 2110 and clean the decoupled dust collection unit 2130.

Figure 17:
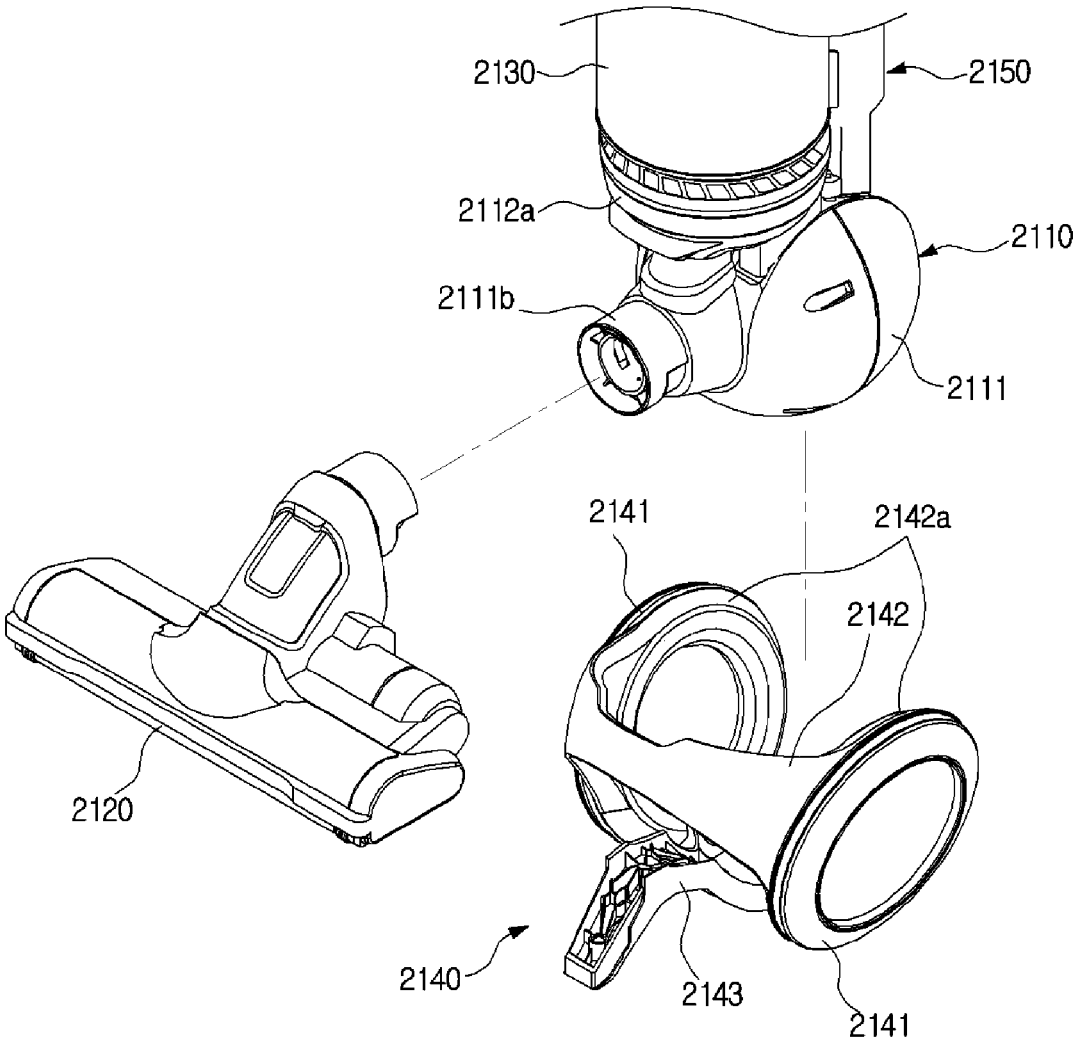
FIGS. 17 and 18 are exploded perspective views illustrating coupling of an upright main body and a wheel assembly in the vacuum cleaner according to the third embodiment of the present disclosure.
Figure 18:
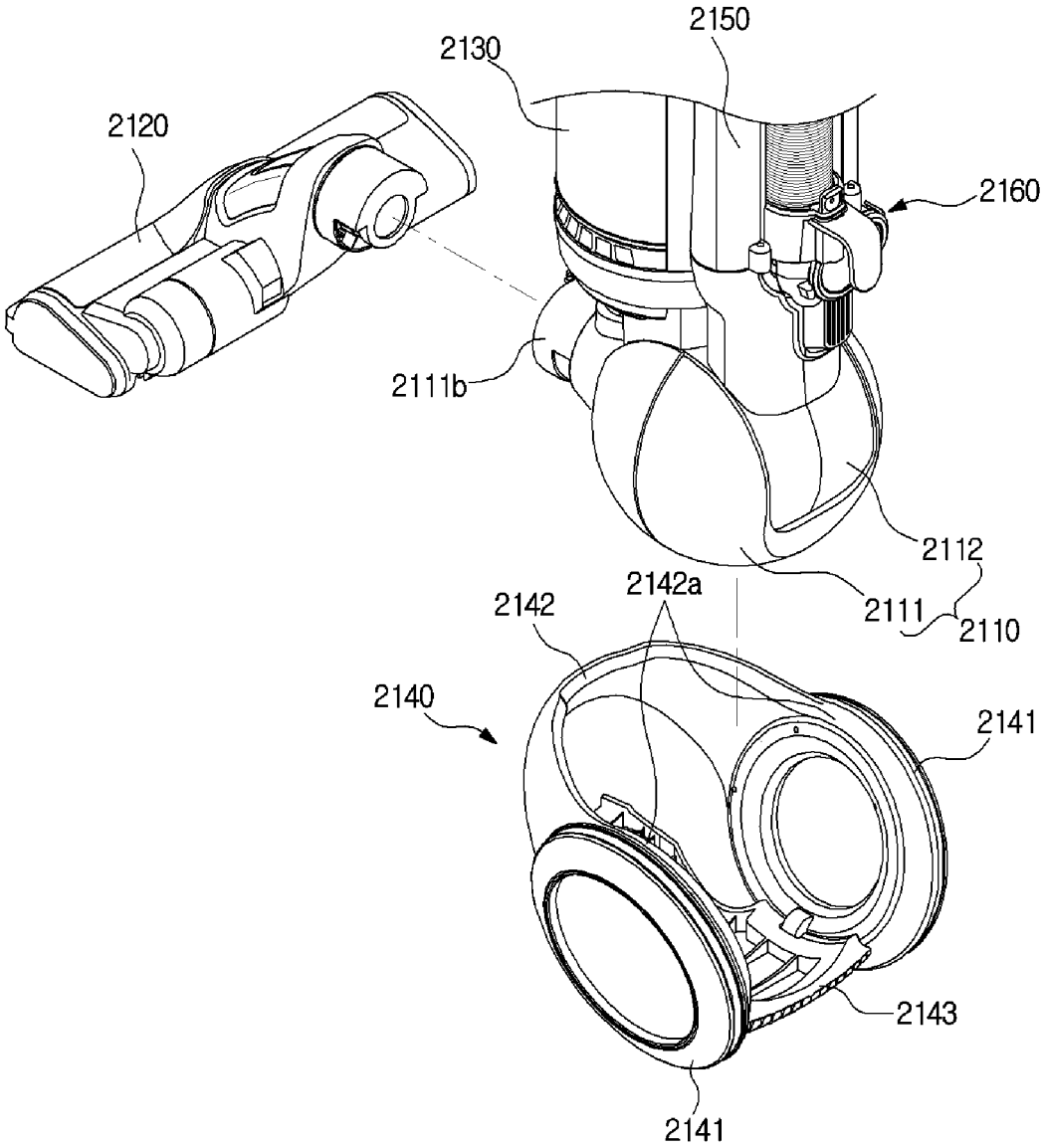

As illustrated in FIGS. 17 and 18, the wheel assembly 2140 includes a pair of wheels 2141 that support the first housing 2111 of the upright main body 2110 so as to be rotatable in the leftward/rightward direction and are disposed on both left and right sides thereof, a wheel bracket 2142 on which the two wheels 2141 are rotatably installed and which rotatably supports the upright main body 2110, and a stationary bracket 2143 that is fixed to a lower portion of the wheel bracket 2142.

The two wheels 2141 are each formed in an annular shape, and are rotatably installed on the wheel bracket 2142.

The stationary bracket 2143 is fixed to lower portions of two wheel mounts 2142*a* so as to allow the two wheel mounts 2142*a* to be mutually supported. The head unit 2120 is fixed at a front side of the stationary bracket 2143 such that the head unit 2120 can be fixedly installed on the wheel assembly 2140.

Figure 19:
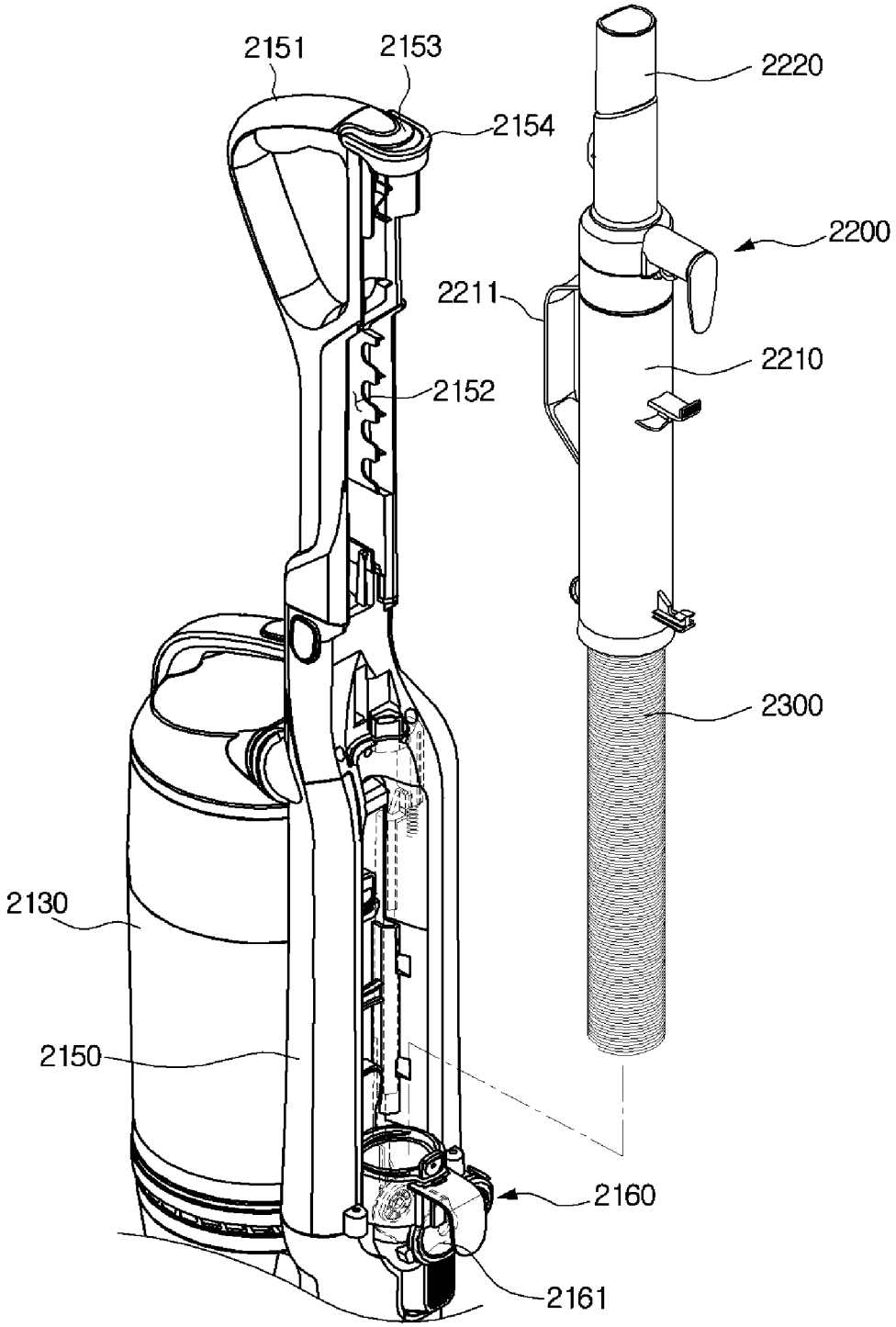
FIG. 19 is a rear perspective view illustrating a state in which the pipe module is decoupled from an extension frame in the vacuum cleaner according to the third embodiment of the present disclosure.

As illustrated in FIG. 19, an upper portion of the extension frame 2150 is provided with a handle 2151 that enables the user to apply a force to the vacuum cleaner so as to move the vacuum cleaner. Thereby, the user can use the vacuum cleaner 21 in a standing state.

Further, the aforementioned dust collection unit 2130 is removably installed at a front side of the extension frame 2150, and the aforementioned pipe module 2200 is removably installed at a rear side of the extension frame 2150. To couple the pipe module 2200, a seating recess 2152 on which a pipe handle 2211 of the pipe module 2200 and a part of the pipe body 2210 are seated are provided at the rear side of the extension frame 2150.

An upper end of the extension frame 2150 is provided with a cover 2153 that is formed in a shape corresponding to an upper end of an open extension pipe 2220 and covers the upper end of the extension pipe 2220, and a locking lever 2154 that is rotatably installed adjacent to the cover 2153 and locks the upper end of the extension pipe 2220. In the present embodiment, each of the cover 2153 and the locking lever 2154 includes a semicircular end so as to correspond to the upper end of the extension pipe 2220.

Thus, in the process of seating the pipe module 2200 on the seating recess 2152 of the extension frame 2150, the upper end of the open extension pipe 2220 is covered by the cover 2153, preventing foreign materials from flowing into the extension pipe 2220. After the upper end of the extension pipe 2220 is covered by the cover 2153, the locking lever 2154 is rotated to support the upper end of the extension pipe 2220. Thereby, the pipe module 2200 can be kept installed on the extension frame 2150 in a stable way.

The pipe module 2200 includes a pipe body 2210 formed in a hollow cylindrical shape, and an extension pipe 2220 that is movably installed in the pipe body 2210 so as to enable the user to easily clean a place separated from the pipe body 2210.

The pipe body 2210 has the pipe handle 2211 at one side thereof which is formed in a hollow shape and which the user can grasp.

The connecting hose 2300 is fixed inside the pipe body 2210 through an open lower end (based on the figure) of the pipe body 2210 such that a part of the connecting hose 2300 can be housed in the pipe body 2210.

Further, the extension pipe 2220 is movably installed on the upper end (based on the figure) of the pipe body 2210. Thus, an entire length of the pipe module 2200 can be increased by causing the extension pipe 2220 to protrude from the pipe body 2210.

The connecting hose 2300 serves to allow the suction force generated from the fan motor to be transmitted to the pipe module 2200, and is formed in the shape of a bellows tube so as to permit easy deformation and a change in length. The connecting hose 2300 is configured such that a lower end thereof is connected to the second housing 2112 through the channel converter 2160 and an upper end thereof is partly fixed in the pipe body 2210.

Further, the upright cleaner module 2100 includes the channel converter 2160 that allows the suction force generated from the fan motor to be transmitted to any one of the pipe body 2210 and the pipe module 2200.

Figure 20:
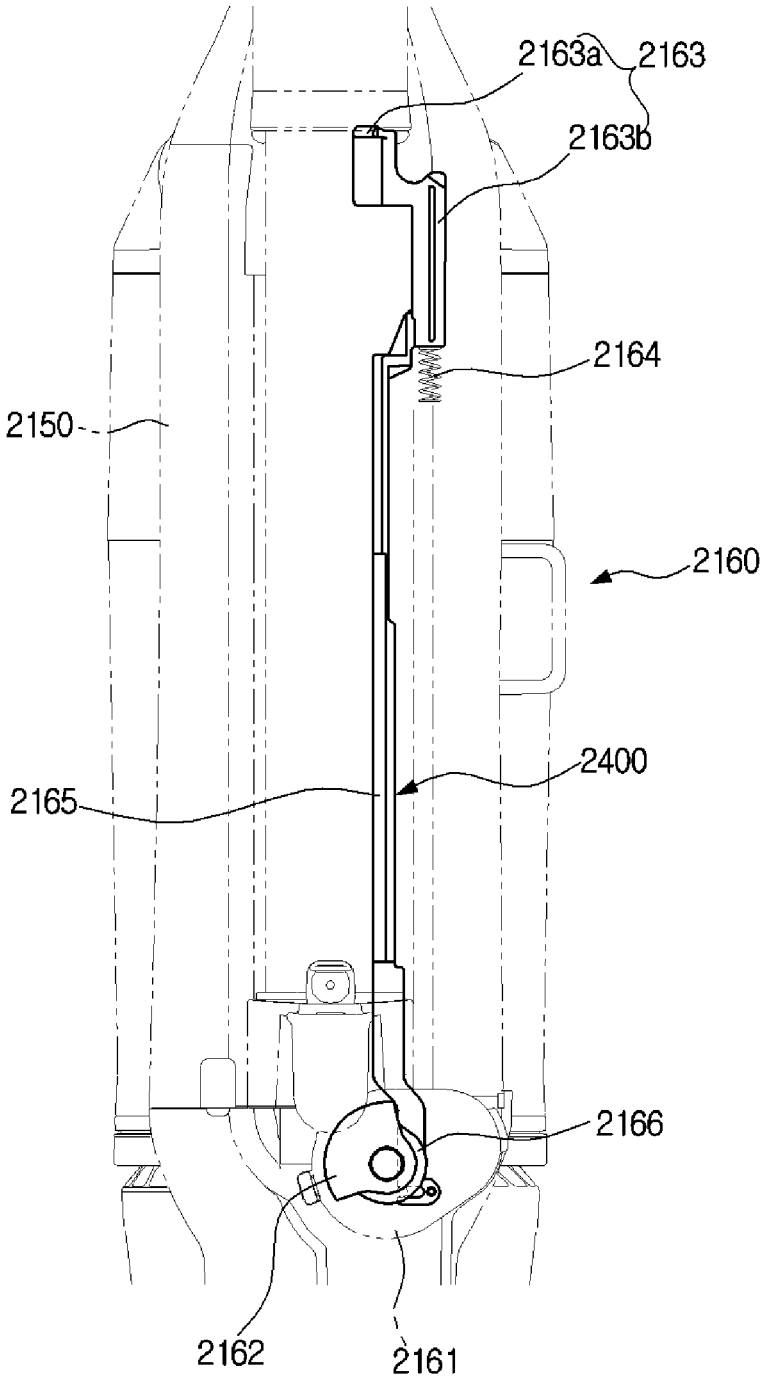
FIG. 20 is a schematic view illustrating an installed state of a channel converter in the vacuum cleaner according to the third embodiment of the present disclosure.
Figure 21:
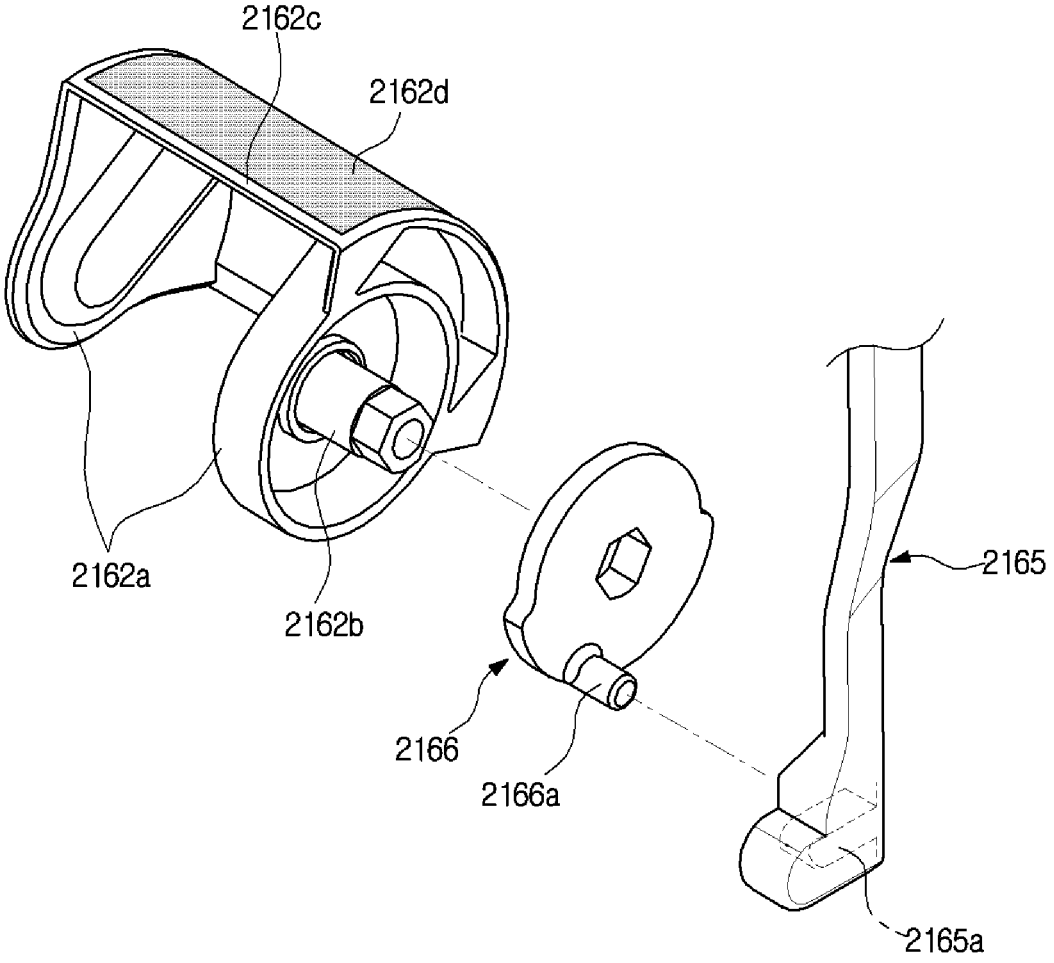
FIG. 21 is a schematic view illustrating an installed state of a damper and a cam of the channel converter in the vacuum cleaner according to the third embodiment of the present disclosure.
Figure 22:
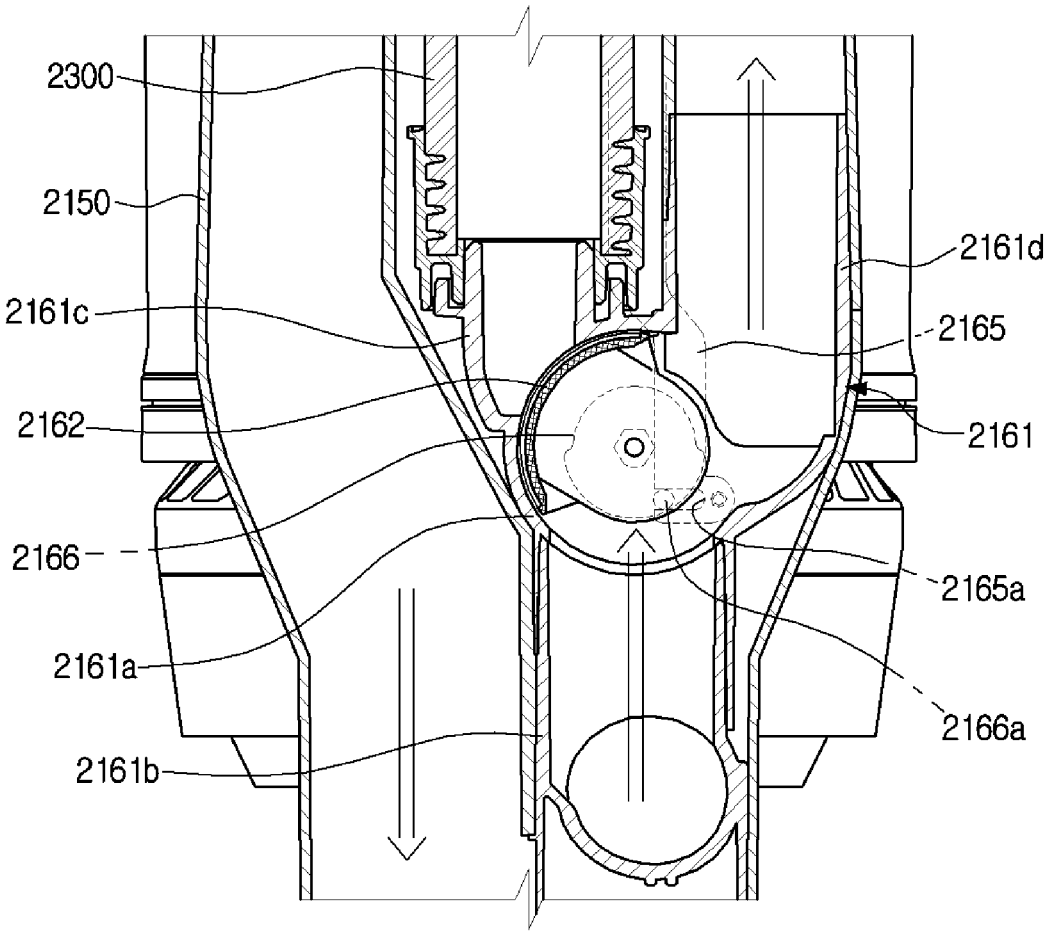
FIGS. 22 and 23 are cross-sectional views illustrating an operation of the damper of the channel converter in the vacuum cleaner according to the third embodiment of the present disclosure.

In the present embodiment, the channel converter 2160 includes, as illustrated in FIGS. 20 to 22, a converting duct 2161 forming a channel, and a damper 2162 that is installed in the converting duct 2161 so as to be able to change a position, and converts the channel in the converting duct 2161 according to the position. In the present embodiment, the damper 2162 is rotatably installed in the converting duct 2161, and selectively opens/closes the channel in the converting duct 2161 according to the rotated position.

Further, the channel converter 2160 includes a damper spring (not shown) that is formed of a torsion spring, is installed on a shaft of the damper 2162 such that the damper 2162 is kept rotated in one direction.

The converting duct 2161 includes a damper driver 2161*a* that forms a cylindrical space in which the damper 2162 is rotatably installed and operated, a first suction channel 2161*b* that extends downward from the damper driver 2161*a* and is connected to the head unit 2120, a second suction channel 2161*c* that extends upward from one side of the damper driver 2161*a* and is connected to the connecting hose 2300, and a discharge channel 2161*d* that is connected to the second housing 2112 housing the fan motor.

The damper 2162 is formed in a sector form, and is rotatably installed in the damper driver 2161*a*. The damper 2162 selectively closes one of the first and second suction channels 2161*b* and 2161*c* according to an angle at which the damper 2162 is rotated in the damper driver 2161*a*, and opens the other such that the channel opened through the damper driver 2161*a* and the discharge channel are connected.

In the present embodiment, the damper 2162 includes a pair of hinges 2162*a*, each of which is formed in an approximate sector form and from the center of which a hinge protrusion 2162*b* is formed to protrude, a damper section 2162*c* that is formed in an arc shape and connects outer circumference sides of the hinges 2162*a*, and a sealing member 2162*d* that is formed of an elastically deformable material and is disposed on an outer circumferential surface of the damper section 2162*c*.

When a force transmitted to the damper 2162 through a converting lever 2165 (to be described below) after the pipe module 2200 is decoupled is released, the damper spring is elastically restored, and is rotated such that the damper 2162 closes the first suction channel 2161*b*.

Depending on whether or not the pipe module 2200 is coupled to the extension frame 2150, the upright main body 2110 causes one of the first and second suction channels 2161*b* and 2161*c* to be selectively connected to the discharge channel 2161*d*. That is, in the state in which the pipe module 2200 is coupled, the suction force generated from the fan motor is not transmitted to the pipe module 2200 but the pipe body 2210 only. Conversely, in the state in which the pipe module 2200 is decoupled from the upright cleaner module 2100, the suction force is not transmitted to the pipe body 2210 but to the pipe module 2200 only.

Further, the upright main body 2110 includes a button 2163 that is movably installed on the extension frame 2150 and is pressed by the pipe module 2200 when the pipe module 2200 is mounted on the extension frame 2150, a button spring 2164 that elastically supports the button 2163 in an upward direction, the converting lever 2165 that moves up or down with upward or downward movement of the button 2163, and a cam 2166 that is rotatably installed outside the converting duct 2161 and is rotated by the converting lever 2165. The center of rotation of the cam 2166 is connected to the hinge protrusion 2162*b* of the damper 2162, and the cam 2166 is rotated along with the damper 2162.

The cam 2166 is provided with a cam protrusion 2166*a* protruding from a circumferential edge thereof in one direction. A lower end of the converting lever 2165 is provided with a cam recess 2165*a* that extends in a leftward/rightward direction and is installed such that the cam protrusion 2166*a* can move left and right. Thus, as the converting lever 2165 moves, the cam protrusion 2166*a* moves along the cam recess 2165*a*, and the cam 2166 rotates, and thus the damper 2162 rotates.

Meanwhile, the button 2163 includes a button section 2163*a* that protrudes outside the extension frame 2150, and a movement guide 2163*b* that is movably installed on the extension frame 2150 and guides movement of the button 2163. The aforementioned button spring 2164 elastically supports the movement guide 2163*b*.

Figure 24:
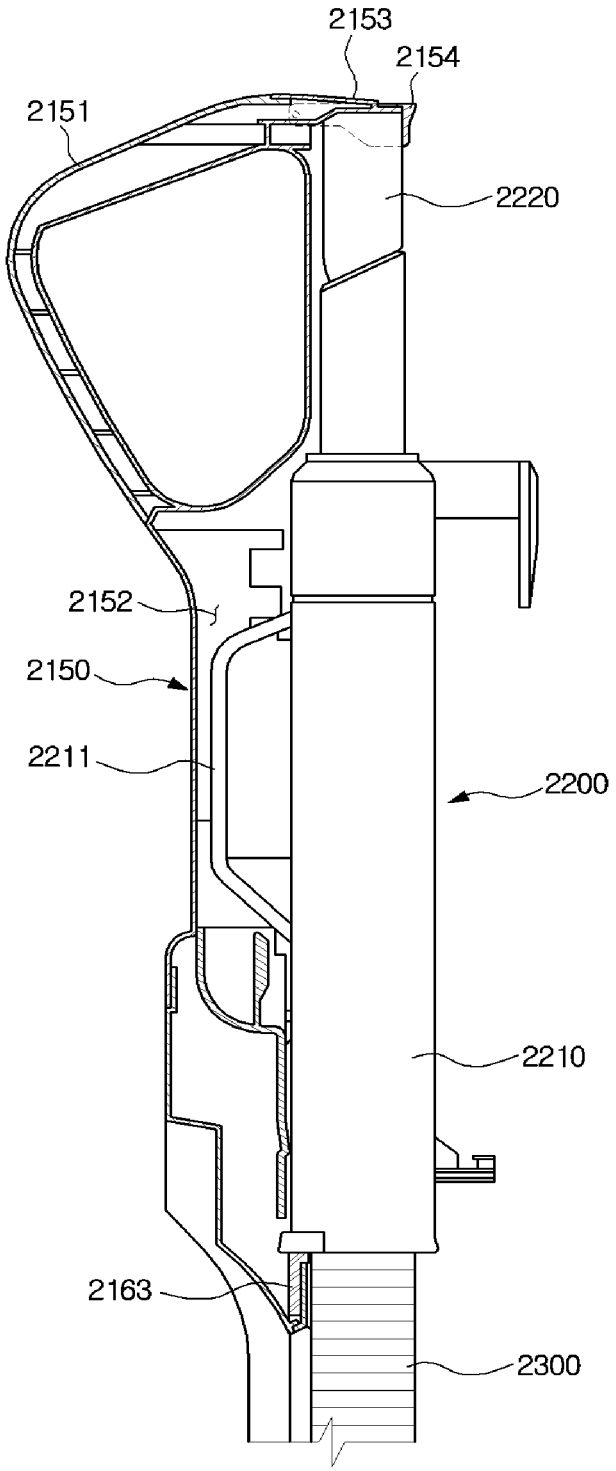
FIGS. 24 and 25 are cross-sectional views illustrating an operation of a button depending on whether or not the pipe module is decoupled in the vacuum cleaner according to the third embodiment of the present disclosure.

Thus, as illustrated in FIG. 24, when the pipe module 2200 is mounted on the extension frame 2150 of the upright cleaner module 2100, the button 2163 is moved downward by the pipe body 2210 in the process of mounting the pipe module 2200 on the extension frame 2150. The converting lever 2165 moves downward along with the button 2163, and the cam 2166 is rotated by receiving a force through the cam protrusion 2166*a* fitted in the cam recess 2165*a* of the converting lever 2165. The damper 2162 is rotated in one direction by the rotation of the cam 2166. Thereby, as illustrated in FIG. 22, the second suction channel 2161*c* is closed, and the first suction channel 2161*b* is opened. Thus, the first suction channel 2161*b* and the discharge channel 2161*d* are interconnected through the damper driver 2161*a*. As a result, the suction force generated from the fan motor is transmitted to the head unit 2120 through the discharge channel 2161*d*, the damper driver 2161*a*, and the first suction channel 2161*b*, and can clean the floor through the head unit 2120.

Figure 23:
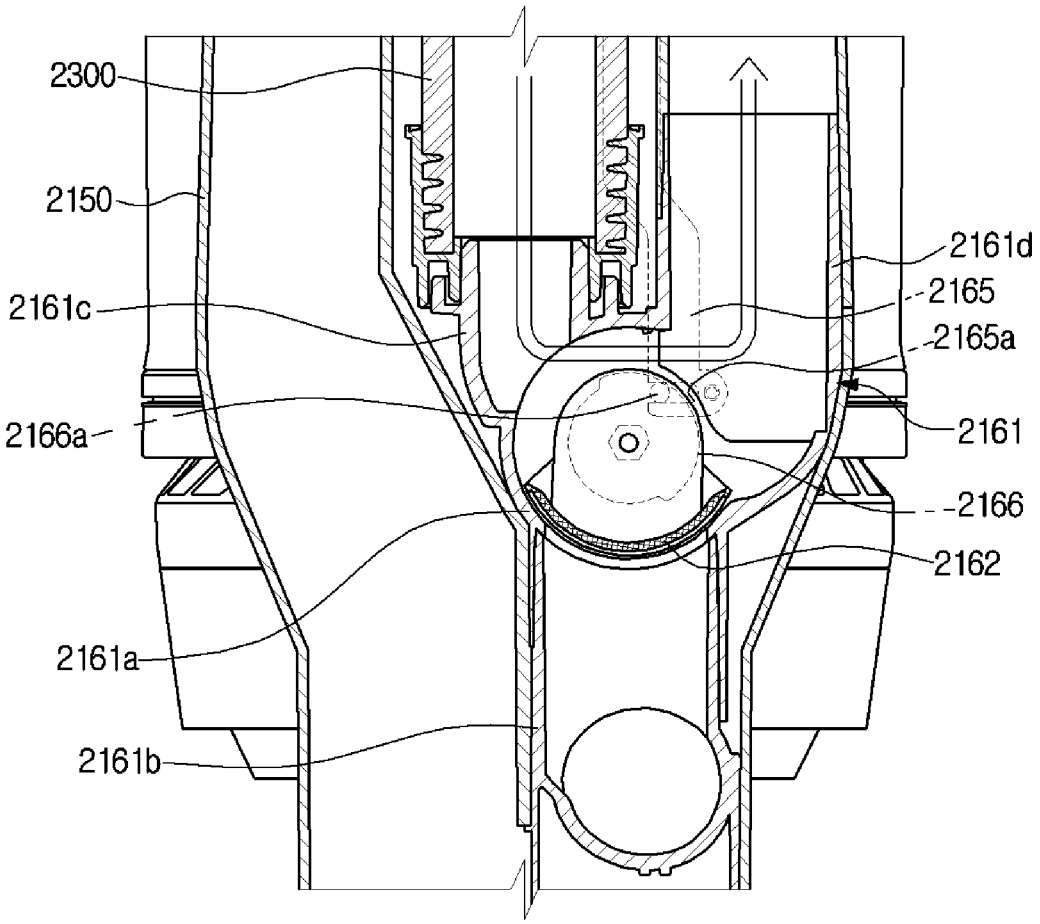
Figure 25:
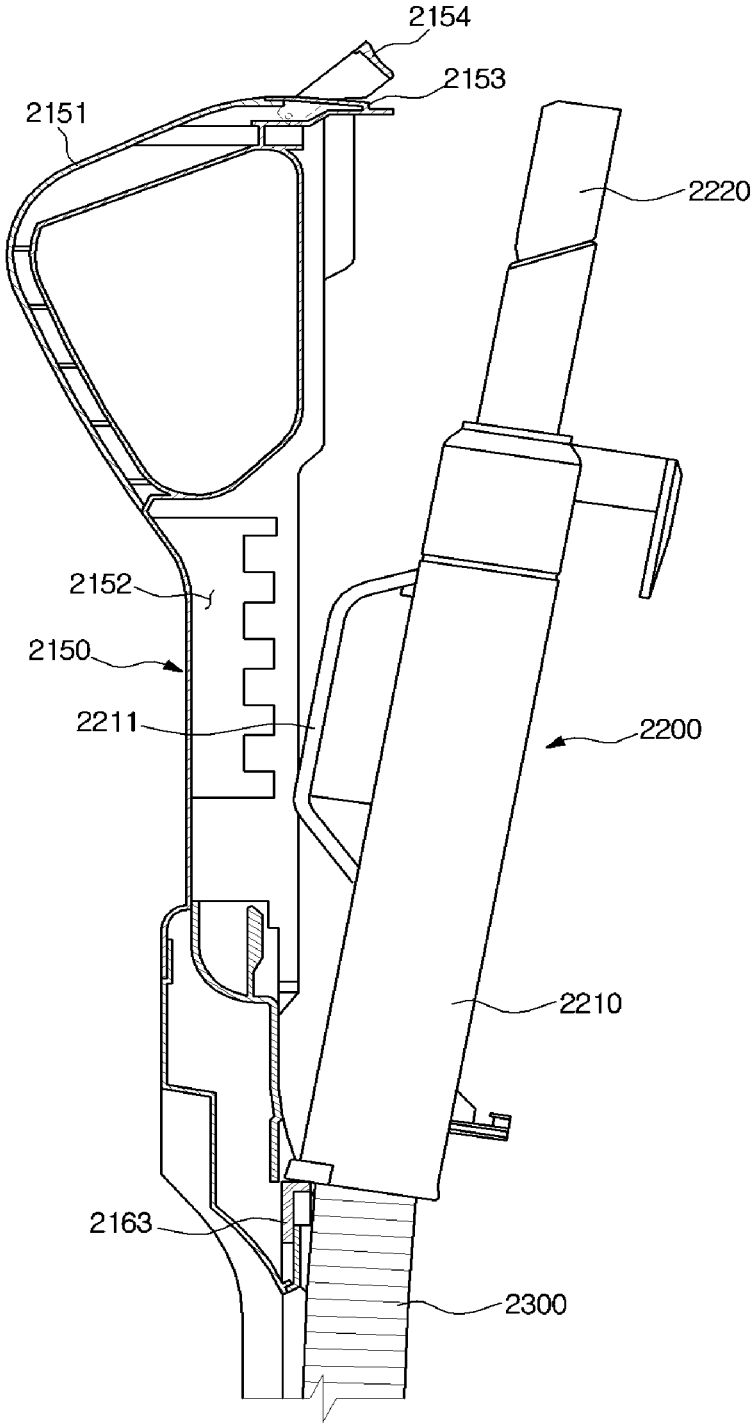

Next, when the pipe module 2200 is decoupled from the upright cleaner module 2100 as illustrated in FIG. 25, the button spring 2164 elastically supporting the button 2163 is elastically restored to cause the button 2163 and the converting lever 2165 to move upward, and thus the force acting on the cam 2166 is released. Thus, the damper spring elastically supporting the damper 2162 is elastically restored to rotate the damper 2162 in a direction opposite to the previous rotational direction. Thereby, as illustrated in FIG. 23, the first suction channel 2161*b* is closed, and the second suction channel 2161*c* is opened. Thus, the second suction channel 2161*c* and the discharge channel 2161*d* are interconnected through the damper driver 2161*a*. As a result, the suction force generated from the fan motor is transmitted to the pipe module 2200 through the discharge channel 2161*d*, the damper driver 2161*a*, and the second suction channel 2161*c*, and can clean the floor through the pipe module 2200.

In the present embodiment, the first suction channel 2161*b* and the second suction channel 2161*c* extend in the vertical direction, and are opposite to each other such that they are partly offset. However, the present embodiment is not limited thereto. The first suction channel 2161*b* and the second suction channel 2161*c* may be formed on the same straight line so as to be opposite to each other, or be opposite to each other in a completely offset state. Further, the first suction channel 2161*b* and the second suction channel 2161*c* may extend to form a fixed angle therebetween. In this way, the first suction channel 2161*b* and the second suction channel 2161*c* may be variously configured.

Further, in the present embodiment, the damper 2162 is rotatably installed on the damper driver 2161*a*, but is not limited thereto. The damper 2162 may be installed on the damper driver 2161*a* so as to be movable up and down or left and right and to selectively open one of the first suction channel 2161*b* and the second suction channel 2161*c*. Further, in the damper 1162 moving in this way, when a movement direction of the damper 2162 is identical to that of the converting lever 2165, the converting lever 2165 and the damper 2162 may be integrally formed.

In the present embodiment, the button spring 2164 is adapted to elastically support the button 2163 in an upward direction, and the button 2163 is adapted to move downward by the pipe module 2200 when the pipe module 2200 is mounted on the upright cleaner module 2100. However, this shows one embodiment. Conversely, the button spring 2164 may be adapted to elastically support the button 2163 in a downward direction, and the button 2163 may be adapted to move upward by the pipe module 2200 when the pipe module 2200 is mounted on the upright cleaner module 2100.

Figure 26:
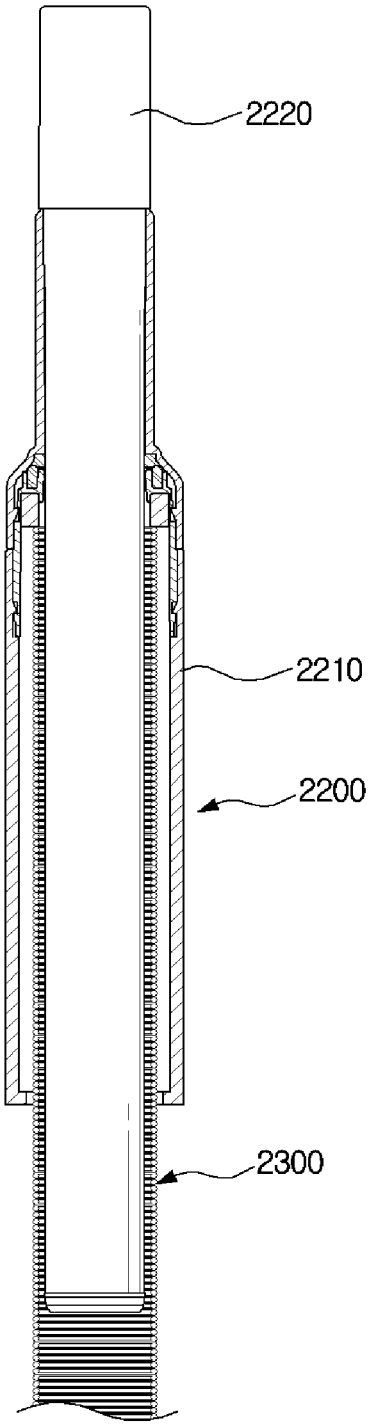
FIGS. 26 and 27 are cross-sectional views illustrating movement of a connecting hose that is movably installed in a pipe body in the vacuum cleaner according to the third embodiment of the present disclosure.
Figure 27:
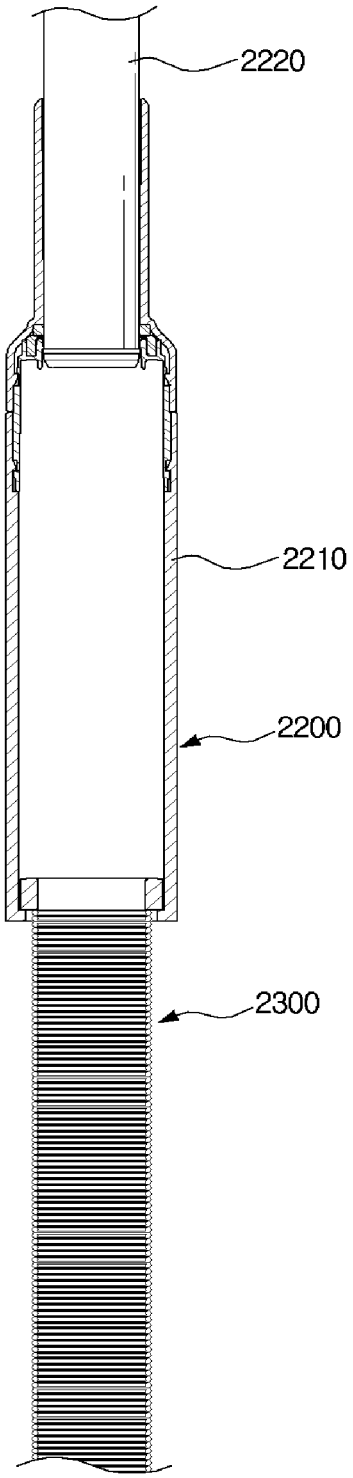

In the present embodiment, the upper end of the connecting hose 2300 is fixed in the pipe body 2210, but is not limited thereto. As illustrated in FIGS. 26 and 27, the upper end of the connecting hose 2300 may be movably installed inside the pipe body 2210 so as to allow the pipe module 2200 to move further away from the upright cleaner module 2100 by a length corresponding to a movement distance of the connecting hose 2300.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A vacuum cleaner comprising:

an upright main body;

an upright fan motor generating a suction force; and a wheel assembly that is mounted on the upright main body and guides movement and rotation of the upright main body, wherein the upright main body includes a first housing that is installed on the wheel assembly so as to be rotatable in a leftward/rightward direction, and a second housing that is installed in the first housing so as to be rotatable in a forward/backward direction and houses the upright fan motor.

2. The vacuum cleaner according to claim 1, further comprising a head unit that is connected at a front side of the upright main body and suctions foreign materials from a floor to be cleaned, wherein:

the head unit includes a connecting tube that is formed in a hollow cylindrical shape, extends backward, and is connected to the upright main body; and the first housing has a center of rotation located on an extension line of a central axis of the connecting tube.

3. The vacuum cleaner according to claim 2, wherein the head unit is rotated left or right relative to the wheel assembly by leftward or rightward rotation of the upright main body.

4. The vacuum cleaner according to claim 3, wherein:

one of the upright main body and the wheel assembly includes a pair of guide rails that extend to be inclined toward a rear lower side; and the other of the upright main body and the wheel assembly includes a pair of guides that are installed to move along the guide rails.

5. The vacuum cleaner according to claim 3, wherein:

the upright main body is formed to have a spherical surface at both sides of the front thereof;

the wheel assembly includes a pair of rotatable wheels and a wheel bracket on which the pair of wheels are rotatably installed;

the guide rails are formed at both sides of the front of the upright main body formed in the spherical surface; and the guides are formed inside the wheel bracket.

6. The vacuum cleaner according to claim 5, wherein the spherical surface has a center identical to the center of rotation of the first housing.

7. The vacuum cleaner according to claim 5, wherein the wheel assembly includes multiple rollers that are disposed inside the wheel bracket and rotatably support the first housing.

8. The vacuum cleaner according to claim 5, wherein the pair of wheels have positive (+) camber.

9. The vacuum cleaner according to claim 2, further comprising an upright dust collection unit that is mounted at an upper portion of the second housing and collects dust from air suctioned through the head unit.

10. The vacuum cleaner according to claim 1, wherein the upright main body includes a locking jaw protruding from one of an inner surface of the first housing and an outer surface of the second housing, and a locking member that is provided for the other of the inner surface of the first housing and the outer surface of the second housing, moves along with rotation of the second housing, and is locked by the locking jaw.

11. The vacuum cleaner according to claim 10, wherein the locking member includes a roller.

12. The vacuum cleaner according to claim 11, wherein:

the upright main body further includes a locking bracket on which the locking member is rotatably installed, and at least one spring, one end of which is supported on the second housing, and the other end of which is supported on the locking bracket; and the locking jaw is provided for the inner surface of the first housing.

13. The vacuum cleaner according to claim 10, further comprising an extension frame that extends upward from the upright main body, wherein the locking member is locked by the locking jaw in a state in which the extension frame is vertically disposed.

14. The vacuum cleaner according to claim 1, further comprising:

an extension frame that extends upward from the second housing; and a handy cleaner module that is removably installed on the extension frame.

15. The vacuum cleaner according to claim 14, wherein:

the handy cleaner module includes a handy main body; and the handy main body includes a handle provided to be graspable by a user.

* * * * *